US012163770B2

(12) United States Patent
Padgett et al.

(10) Patent No.: US 12,163,770 B2
(45) Date of Patent: Dec. 10, 2024

(54) POLYMER CARTRIDGE WITH ENHANCED SNAPFIT METAL INSERT AND THICKNESS RATIOS

(71) Applicants: PCP TACTICAL, LLC, Vero Beach, FL (US); SABIC GLOBAL TECHNOLOGIES B.V., Bergen Op Zoom (NL)

(72) Inventors: Charles Padgett, Vero Beach, FL (US); Lanse Padgett, Vero Beach, FL (US); Mark A. Sanner, Bergen Op Zoom (NL); Ernest Ford Caldwell, Bergen Op Zoom (NL); Gerould Harding, Bergen Op Zoom (NL); Christopher Wall, Bergen Op Zoom (NL)

(73) Assignees: PCP TACTICAL, LLC, Sebastian, FL (US); SABIC GLOBAL TECHNOLOGIES B.V., Bergen op Zoom (NL)

( * ) Notice: Subject to any disclaimer, the term of this patent is extended or adjusted under 35 U.S.C. 154(b) by 0 days.

(21) Appl. No.: 17/941,125

(22) Filed: Sep. 9, 2022

(65) Prior Publication Data

US 2023/0184523 A1 Jun. 15, 2023

Related U.S. Application Data

(63) Continuation of application No. 17/265,179, filed as application No. PCT/US2019/043743 on Jul. 26, 2019, now Pat. No. 11,448,491.

(Continued)

(51) Int. Cl.
*F42B 5/307* (2006.01)

(52) U.S. Cl.
CPC ..... *F42B 5/307* (2013.01)

(58) Field of Classification Search
CPC ..... F42B 5/313; F42B 5/307

(Continued)

(56) References Cited

U.S. PATENT DOCUMENTS 498,856 A 6/1893 Overbaugh
517,719 A 4/1894 Aikin (Continued)

FOREIGN PATENT DOCUMENTS

AU 1350583 A 10/1983
BE 709551 A 5/1968

(Continued)

OTHER PUBLICATIONS

Chung, Jerry S., "Alternative Cartridge Case Material and Design", Armament Research, Development and Engineering Center Technical Report ARAEW-TR-05007, May 2005.

(Continued)

*Primary Examiner* — Reginald S Tillman, Jr.
(74) *Attorney, Agent, or Firm* — Troutman Pepper Hamilton Sanders LLP

(57) ABSTRACT

A high strength polymer-based cartridge having a polymer case with a first end having a mouth. A body can be formed below the mouth and having a propellant chamber and a longitudinal axis. A back end can be formed opposite the first end and formed below the body, with a first snap ridge comprising a first ridge angle at approximately at 90° to the longitudinal axis; and a second snap ridge, positioned closer to the first end than the first snap ridge, comprising a second ridge angle at approximately at 90° to the longitudinal axis. Further, an insert is configured to engage the back end.

3 Claims, 29 Drawing Sheets

Related U.S. Application Data

(60) Provisional application No. 62/711,958, filed on Jul. 30, 2018.

(58) Field of Classification Search
USPC ..... 102/466–467
See application file for complete search history.

(56) References Cited

U.S. PATENT DOCUMENTS 539,327 A 5/1895 Aikin
546,936 A 9/1895 Pinfold
692,819 A 2/1902 Bissel
812,156 A 2/1906 Sparre
827,600 A 7/1906 Bailey
980,351 A 1/1911 Sherman
1,038,078 A 9/1912 Bjorgum
1,118,888 A 11/1914 Butler
1,233,071 A 7/1917 Lindquist
1,292,359 A 1/1919 Nelson
1,319,185 A 10/1919 Smith et al.
2,022,685 A 12/1935 Moore
2,263,941 A 11/1941 George
2,294,822 A 9/1942 George
2,366,887 A 1/1945 Warren
2,379,510 A 7/1945 Ewart
2,395,460 A 2/1946 Carten
2,401,050 A 5/1946 Cooper et al.
2,402,068 A 6/1946 Meador
2,426,448 A 8/1947 Goldfisher
2,435,590 A 2/1948 Holroyd
2,455,080 A 11/1948 Miller et al.
2,481,726 A 9/1949 Muschamp
2,489,953 A 11/1949 Burney
2,648,258 A 8/1953 Simpson
2,654,319 A 10/1953 Roske
2,862,446 A 12/1958 Ringdal
2,915,424 A 12/1959 Lyon
2,915,947 A 12/1959 Heeley
2,918,868 A 12/1959 Ringdal
2,972,947 A 2/1961 Fitzsimmons
2,995,090 A 8/1961 Daubenspeck
3,034,433 A 5/1962 Gronn
3,048,104 A 8/1962 Riggs
3,078,765 A 2/1963 Falcone et al.
3,099,958 A 8/1963 Daubenspeck et al.
3,123,003 A 3/1964 Lange, Jr. et al.
3,136,052 A 6/1964 Pickart
3,144,827 A 8/1964 Boutwell et al.
3,233,546 A 2/1966 Foote et al.
3,253,512 A 5/1966 Schallehn
3,333,506 A 8/1967 Henshaw et al.
3,336,871 A 8/1967 Quinlan
3,339,487 A 9/1967 Umbach et al.
3,351,014 A 11/1967 Metcalf et al.
3,435,765 A 4/1969 Gawlick
3,485,170 A 12/1969 Scanlon
3,491,691 A 1/1970 Vawter
3,609,904 A 10/1971 Scanlon
3,628,225 A 12/1971 Parker
3,650,176 A 3/1972 Lindner
3,659,528 A 5/1972 Santala
3,696,705 A 10/1972 Hrabovsky
3,706,260 A 12/1972 Rausing
3,712,172 A 1/1973 Wiese
3,726,218 A 4/1973 Austin, Jr.
3,732,826 A 5/1973 Johnson
3,745,924 A 7/1973 Scanlon
3,749,020 A 7/1973 Weyhmuller
3,749,021 A 7/1973 Burgess
3,749,023 A 7/1973 Kawaguchi et al.
3,785,293 A 1/1974 Barr et al.
3,797,396 A 3/1974 Reed
3,808,974 A 5/1974 Herter
3,818,834 A 6/1974 Baumgartener
3,830,157 A 8/1974 Donnard et al.
3,842,739 A 10/1974 Scanlon et al.
3,855,686 A 12/1974 Snyder
3,861,308 A 1/1975 Grandy
3,874,294 A 4/1975 Hale
3,913,445 A 10/1975 Grandy
3,935,816 A 2/1976 Boquette, Jr.
3,948,178 A 4/1976 Luther et al.
3,955,506 A 5/1976 Luther et al.
3,977,326 A 8/1976 Anderson et al.
3,983,990 A 10/1976 Gardy et al.
3,990,366 A 11/1976 Scanlon
3,999,482 A 12/1976 Bilek
4,004,491 A 1/1977 Seeling
4,004,492 A 1/1977 Savioli
4,038,923 A 8/1977 Cole et al.
4,089,612 A 5/1978 Mazzeo
4,140,058 A 2/1979 Ballreich et al.
4,142,466 A 3/1979 Ballreich et al.
4,147,107 A * 4/1979 Ringdal ..... F42B 5/307 102/467
4,157,684 A 6/1979 Clausser
4,165,943 A 8/1979 Beach et al.
4,173,186 A 11/1979 Dunham
4,187,271 A 2/1980 Rolston et al.
4,290,339 A 9/1981 Skahill
4,359,925 A 11/1982 Abet et al.
4,446,794 A 5/1984 Simmons
4,469,027 A 9/1984 Burns et al.
4,474,102 A 10/1984 Tassie
4,498,396 A 2/1985 Berube
4,508,036 A 4/1985 Jensen et al.
4,546,704 A 10/1985 Ballreich et al.
4,553,479 A 11/1985 Willoughby
4,562,768 A 1/1986 Weinfurth et al.
H61 H 5/1986 Yuhash et al.
4,593,621 A 6/1986 Buchner
4,620,485 A 11/1986 Bertiller
4,683,170 A 7/1987 Tse et al.
4,697,523 A 10/1987 Saxby
4,719,859 A 1/1988 Ballreich et al.
4,726,296 A 2/1988 Leshner et al.
4,738,202 A 4/1988 Hebert
4,790,231 A 12/1988 Stoner
4,803,926 A 2/1989 Barton et al.
4,809,612 A 3/1989 Ballreich et al.
4,841,837 A 6/1989 Novet
4,867,065 A 9/1989 Kaltmann et al.
5,021,206 A 6/1991 Stoops
5,033,386 A 7/1991 Vatsvog
5,063,853 A 11/1991 Bilgeri
5,138,949 A 8/1992 Swartout et al.
5,151,555 A 9/1992 Vatsvog
5,155,295 A 10/1992 Campoli
5,165,040 A 11/1992 Andersson et al.
5,233,928 A 8/1993 Ducros et al.
5,237,930 A 8/1993 Belanger et al.
5,259,288 A 11/1993 Vatsvog
5,259,319 A 11/1993 Dravecky et al.
5,277,119 A 1/1994 Ricco, Sr.
5,359,937 A 11/1994 Dittrich
5,368,526 A 11/1994 Hynes
5,459,914 A 10/1995 Bisping
5,460,096 A 10/1995 Kothe
5,492,063 A 2/1996 Dittrich
5,507,232 A 4/1996 Valdez
5,563,365 A 10/1996 Dineen et al.
5,616,642 A 4/1997 West et al.
5,653,563 A 8/1997 Ernst et al.
5,677,505 A 10/1997 Dittrich
5,703,322 A 12/1997 Tidman
5,708,231 A 1/1998 Koon
5,770,815 A 6/1998 Watson, Jr.
5,804,654 A 9/1998 Lo et al.
5,822,904 A 10/1998 Beal
5,893,959 A 4/1999 Muellich
5,969,288 A 10/1999 Baud
6,040,370 A 3/2000 Wozny et al.
6,048,379 A 4/2000 Bray et al.
6,074,454 A 6/2000 Abrams et al.

(56) References Cited

U.S. PATENT DOCUMENTS 6,101,949 A 8/2000 Maucourt et al.
6,131,519 A 10/2000 Thiesen et al.
6,257,149 B1 7/2001 Cesaroni
6,283,035 B1 9/2001 Olson et al.
6,305,290 B1 10/2001 Stimmell
6,367,386 B1 4/2002 Brede et al.
6,430,861 B1 8/2002 Ayers et al.
6,439,123 B1 8/2002 Dionne et al.
6,523,476 B1 2/2003 Riess et al.
6,539,874 B2 4/2003 Weise
6,584,909 B2 7/2003 Brede et al.
6,598,536 B2 7/2003 Burri
6,600,002 B2 7/2003 Sanderson et al.
6,748,870 B2 6/2004 Heidenreich et al.
6,752,084 B1 6/2004 Husseini et al.
6,832,557 B2 12/2004 Torsten
6,845,716 B2 1/2005 Husseini et al.
6,862,993 B1 3/2005 Cudazzo
6,886,467 B1 5/2005 Haeselich
7,032,492 B2 4/2006 Meshirer
7,059,234 B2 * 6/2006 Husseini ..... F42B 33/001 86/55
7,086,336 B2 8/2006 Smalley, Jr. et al.
7,165,496 B2 1/2007 Reynolds
7,204,191 B2 4/2007 Wiley et al.
7,213,519 B2 5/2007 Wiley et al.
7,231,519 B2 6/2007 Joseph et al.
7,406,908 B1 8/2008 Goon et al.
7,441,504 B2 10/2008 Husseini et al.
7,610,858 B2 11/2009 Chung
7,938,067 B2 5/2011 Dindl et al.
8,087,359 B2 1/2012 Sauvestre
8,146,281 B2 4/2012 Zimmerman
8,151,683 B2 4/2012 Dick et al.
8,240,252 B2 8/2012 Maljkovic et al.
8,342,072 B2 1/2013 Abbott
8,443,730 B2 5/2013 Padgett
8,522,684 B2 9/2013 Davies et al.
8,573,126 B2 11/2013 Klein et al.
8,763,535 B2 7/2014 Padgett
8,807,008 B2 8/2014 Padgett et al.
8,813,650 B2 8/2014 Maljkovic et al.
9,032,855 B1 5/2015 Foren
9,182,204 B2 11/2015 Maljovic
9,188,412 B2 11/2015 Maljkovic et al.
9,296,894 B2 3/2016 Wang et al.
9,335,134 B2 5/2016 Smith
9,335,137 B2 5/2016 Maljkovic et al.
9,395,165 B2 7/2016 Maljkovic
9,964,388 B1 5/2018 Burrow
2003/0019385 A1 1/2003 LeaSure et al.
2003/0167952 A1 9/2003 Heidenreich et al.
2003/0172775 A1 9/2003 Amick
2004/0011237 A1 1/2004 Khvichia et al.
2004/0226472 A1 11/2004 Oda
2004/0237827 A1 12/2004 Smalley et al.
2005/0188879 A1 9/2005 Wiley et al.
2005/0188883 A1 9/2005 Husseini et al.
2005/0257711 A1 11/2005 Husseini et al.
2005/0257712 A1 11/2005 Husseini et al.
2006/0011087 A1 1/2006 Husseini et al.
2006/0102041 A1 5/2006 Wiley et al.
2006/0207464 A1 9/2006 Maljkovic et al.
2007/0193465 A1 8/2007 Stevens
2007/0214992 A1 9/2007 Dittrich
2007/0261587 A1 11/2007 Chung
2008/0245219 A1 10/2008 Moucheboeuf et al.
2009/0044717 A1 2/2009 Husseini et al.
2009/0069489 A1 3/2009 Vollenberg et al.
2009/0114109 A1 5/2009 Overton et al.
2009/0151710 A1 6/2009 Zimmerman
2009/0249947 A1 10/2009 Coiffet et al.
2009/0314178 A1 12/2009 South
2010/0056687 A1 3/2010 Diakoumakos et al.
2010/0275804 A1 11/2010 Trivette
2010/0282112 A1 11/2010 Battaglia
2010/0305261 A1 12/2010 Maljkovic et al.
2011/0000391 A1 1/2011 Heitmann
2011/0179965 A1 7/2011 Mason
2011/0214583 A1 9/2011 Dutch
2011/0252999 A1 10/2011 Carlson et al.
2011/0290141 A1 12/2011 Engel
2011/0290143 A1 12/2011 Heitmann et al.
2012/0012024 A1 1/2012 Scherrer
2012/0024183 A1 2/2012 Klein
2012/0060716 A1 3/2012 Davies et al.
2012/0111219 A1 5/2012 Burrow
2012/0118132 A1 5/2012 Coker et al.
2012/0144712 A1 6/2012 Rostocil
2012/0174813 A1 7/2012 Battaglia
2012/0180687 A1 7/2012 Padgett et al.
2012/0180688 A1 7/2012 Padgett
2012/0199033 A1 8/2012 Bybee
2012/0318128 A1 12/2012 Gotie
2013/0014664 A1 1/2013 Padgett
2013/0025490 A1 1/2013 Burczynski
2013/0186294 A1 7/2013 Davies et al.
2014/0060372 A1 3/2014 Padgett
2014/0060373 A1 3/2014 Maljkovic
2014/0069290 A1 3/2014 Padgett et al.
2014/0076188 A1 3/2014 Maljkovic et al.
2014/0130699 A1 5/2014 Peterson et al.
2014/0329920 A1 11/2014 Rosenquist
2014/0373744 A1 12/2014 Padgett et al.
2015/0033970 A1 2/2015 Maljkovic et al.
2015/0075400 A1 3/2015 Lemke et al.
2015/0122142 A1 5/2015 Padgett
2015/0316361 A1 11/2015 Maljkovic
2016/0003587 A1 1/2016 Burrow
2016/0003588 A1 1/2016 Burrow
2016/0003601 A1 1/2016 Burrow
2016/0025464 A1 1/2016 Maljkovic et al.
2016/0033241 A1 2/2016 Burrow
2016/0054105 A1 2/2016 Beal
2016/0069654 A1 3/2016 Walsh
2016/0131463 A1 * 5/2016 Stauffer ..... F42B 8/12 102/515
2016/0349022 A1 12/2016 Burrow
2016/0349023 A1 12/2016 Burrow
2016/0349028 A1 12/2016 Burrow
2019/0011233 A1 1/2019 Boss et al.

FOREIGN PATENT DOCUMENTS

CN 101137886 A 3/2008
CN 103492493 A 1/2014
CN 104823016 A 8/2015
CN 105452378 A 3/2016
CN 105518074 A 4/2016
CN 107466309 A 12/2017
DE 1113880 B 9/1961
DE 2205619 A1 8/1972
DE 27 05 235 A1 8/1978
DE 3344369 A1 6/1985
EP 0096617 A1 12/1983
EP 131863 A2 1/1985
EP 0444545 A1 9/1991
EP 0526317 A1 2/1993
FR 1081764 A 12/1954
GB 616755 A 1/1949
GB 732633 A 6/1955
GB 2092274 A 8/1982
NO 2006/094987 A1 9/2006
WO 88/09476 A1 12/1988
WO 95/13516 A1 5/1995
WO 99/18408 A1 4/1999
WO 03/036222 A1 5/2003
WO 2005/022072 A2 3/2005
WO 2010/129781 A1 11/2010
WO 2012/047615 A1 4/2012
WO 2012/097317 A2 7/2012
WO 2012/097320 A1 7/2012
WO 2013016730 A1 1/2013

(56) References Cited

FOREIGN PATENT DOCUMENTS

OTHER PUBLICATIONS

International Search Report issued in corresponding International Patent Application No. PCT/US2019/043743 dated Oct. 4, 2019.

* cited by examiner

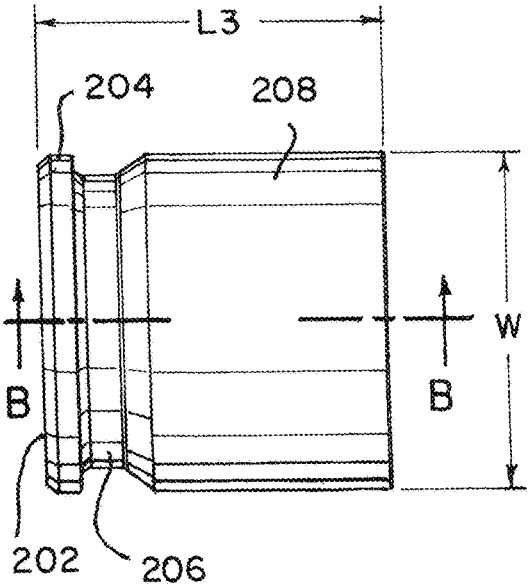
FIG. 3B
FIG. 3C
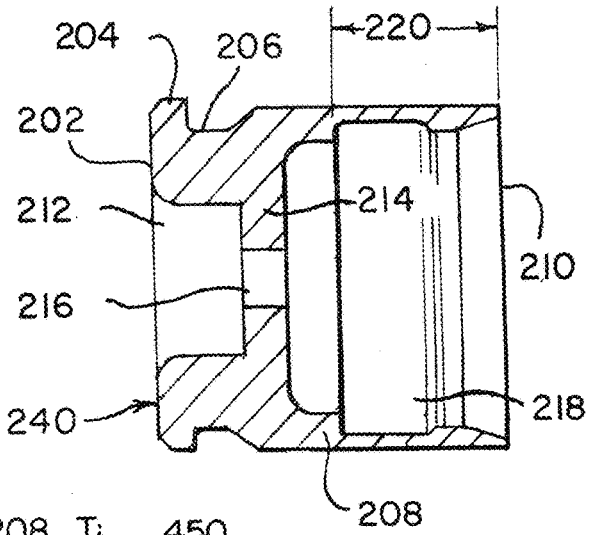
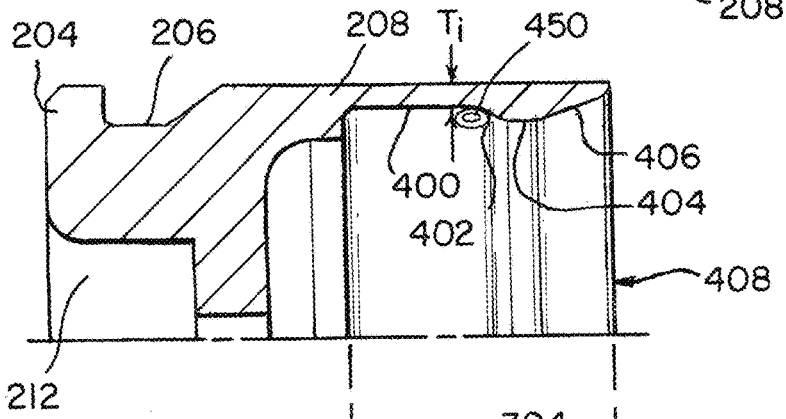
FIG. 4A
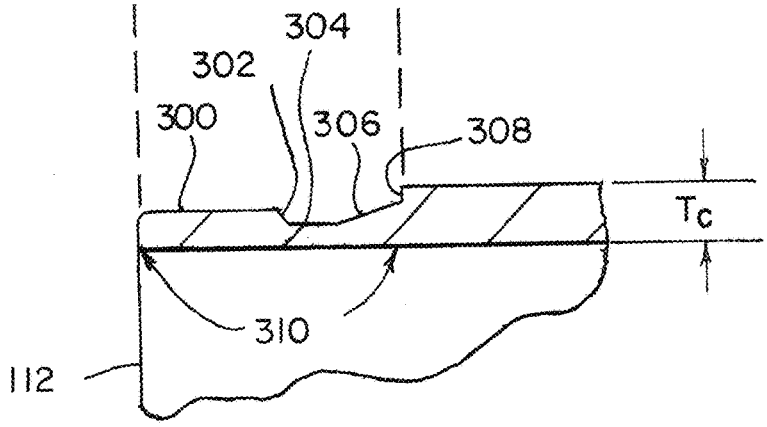
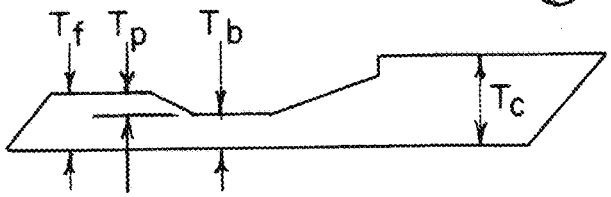
FIG. 4B FIG. 5C
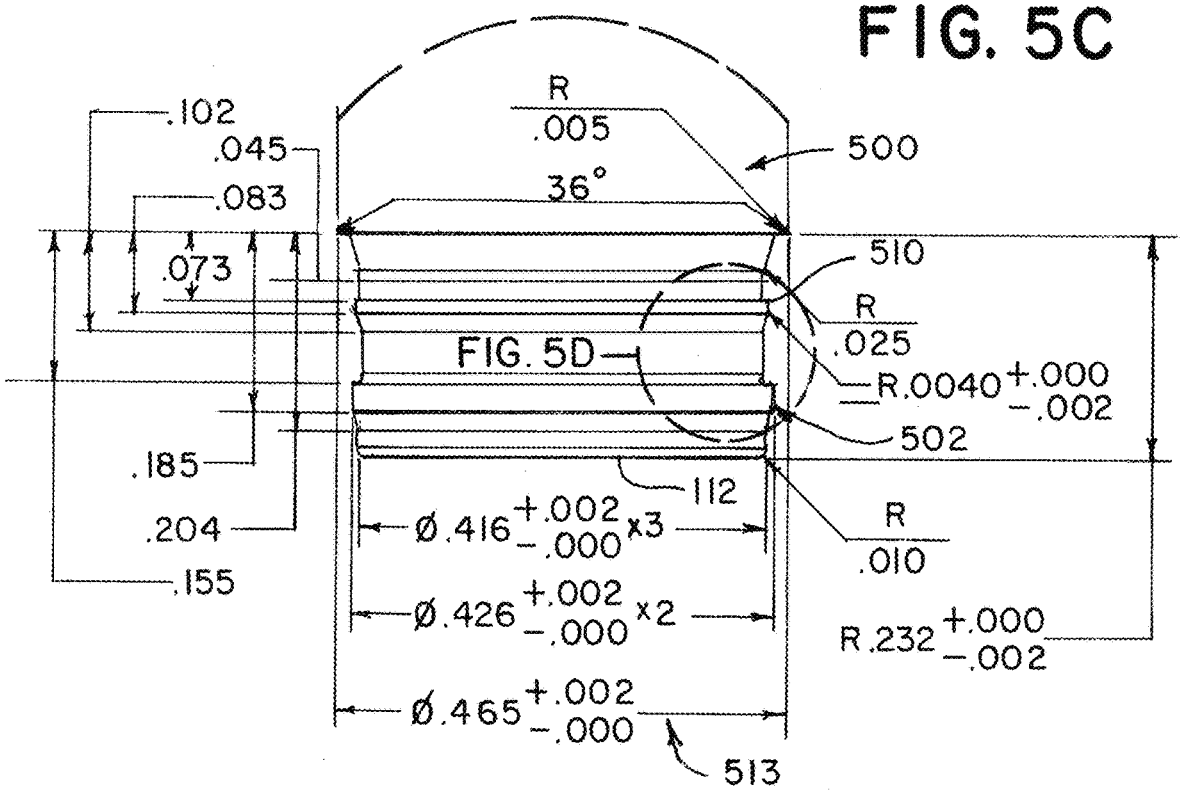
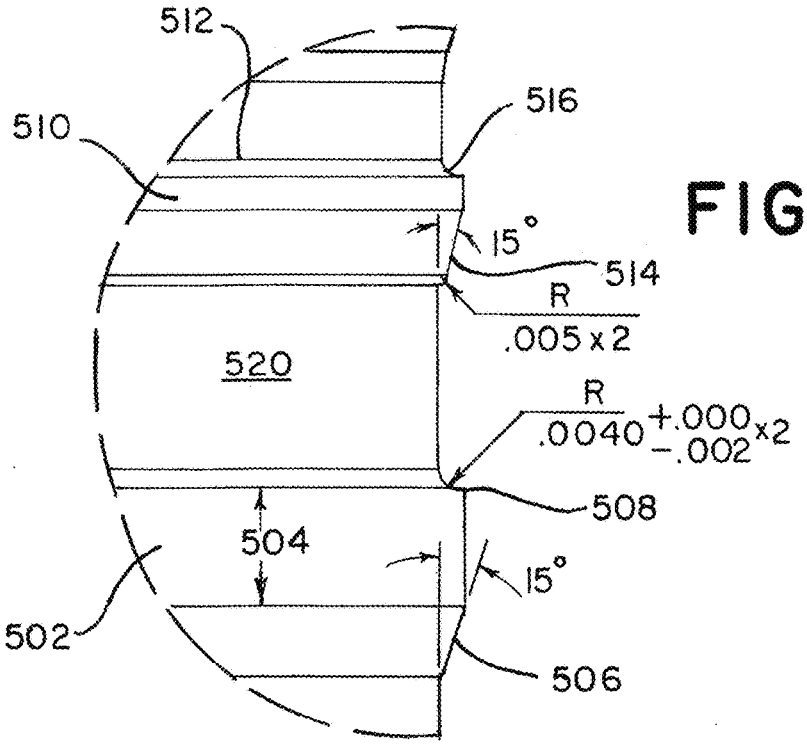
FIG. 5D

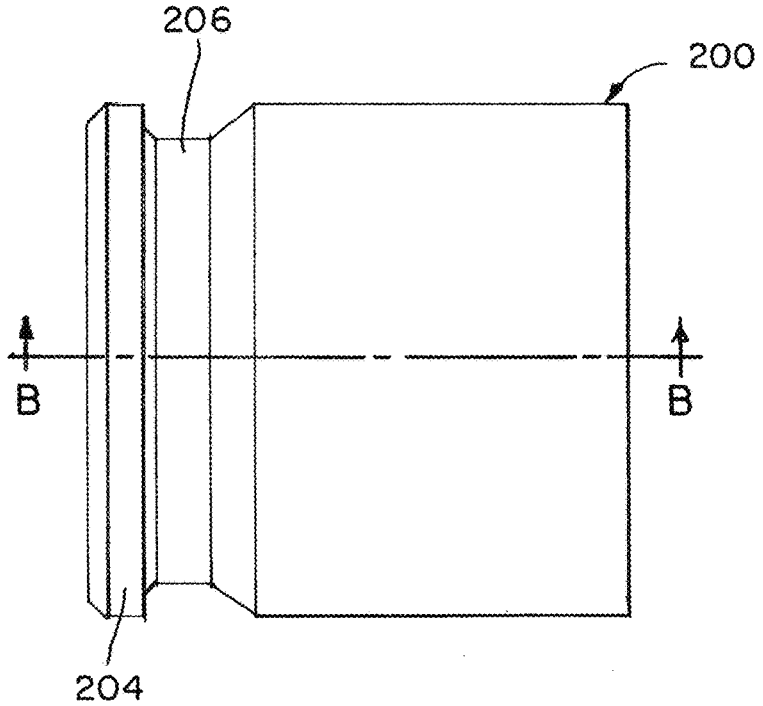
FIG. 6A
FIG. 6B
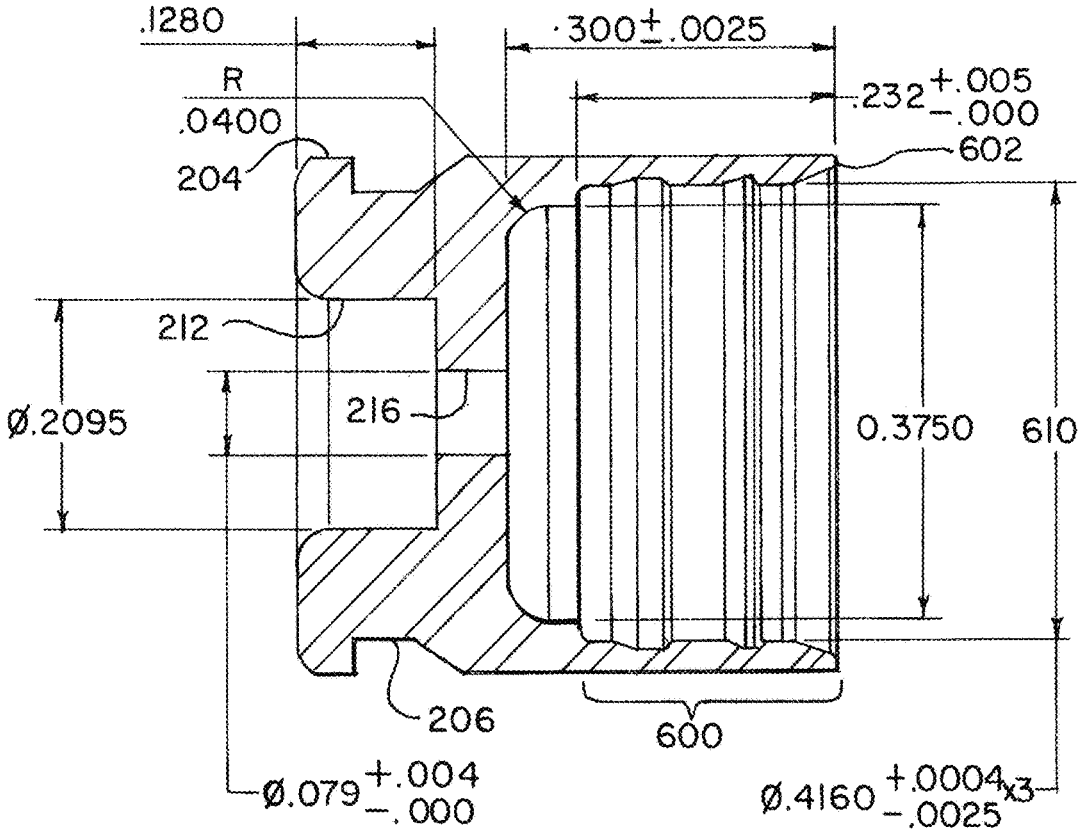

Max Load in Cantilever Testing

Energy Cantilever Testing

FIG. 13C
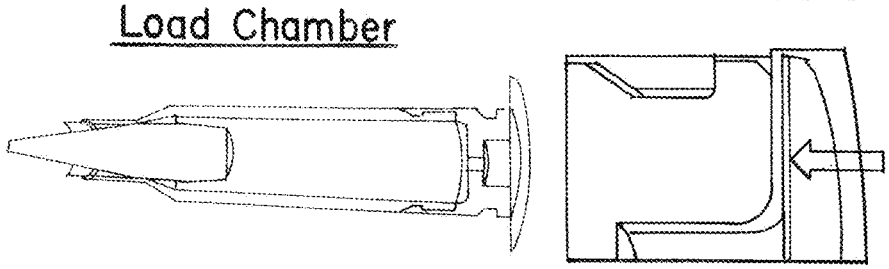
FIG. 13D
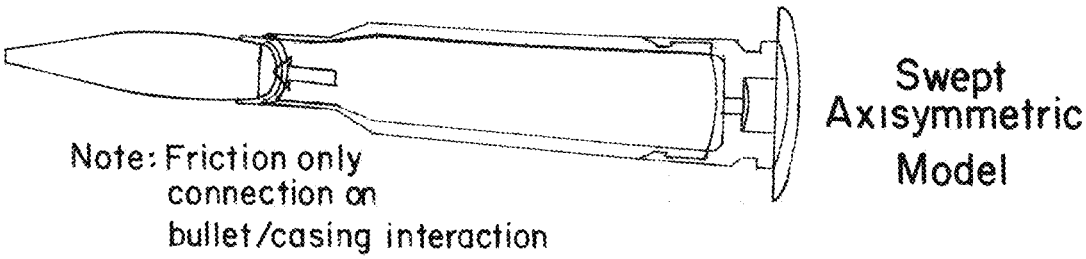
FIG. 14A
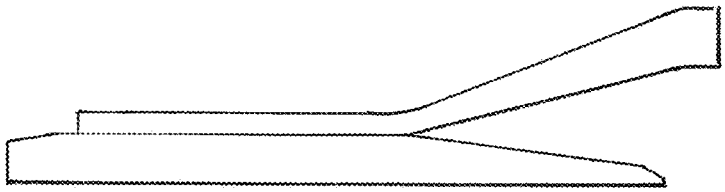
FIG. 14B
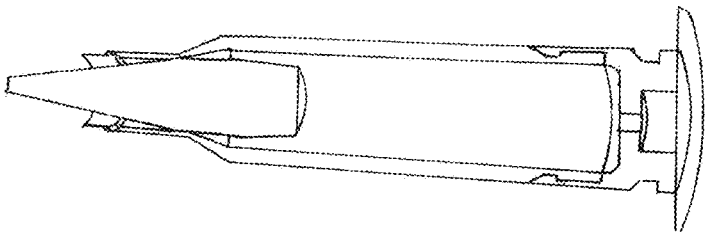
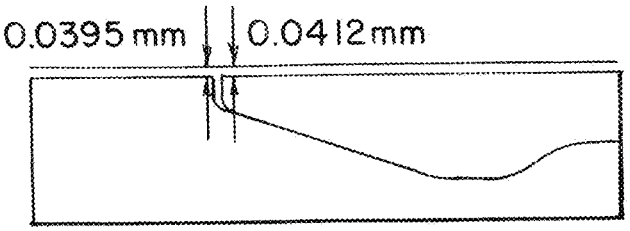
FIG. 14C

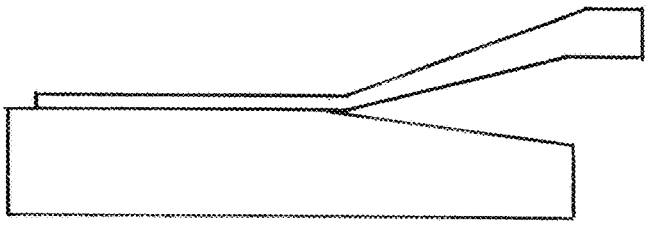
FIG. 14D
FIG. 14E
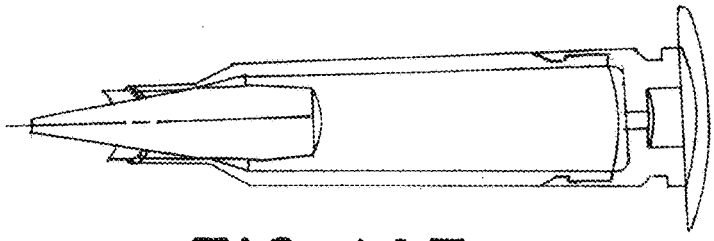
FIG. 14F
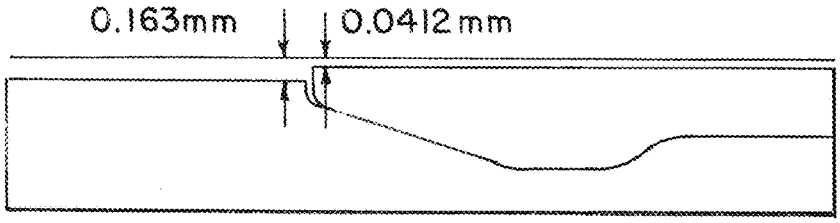
FIG. 15
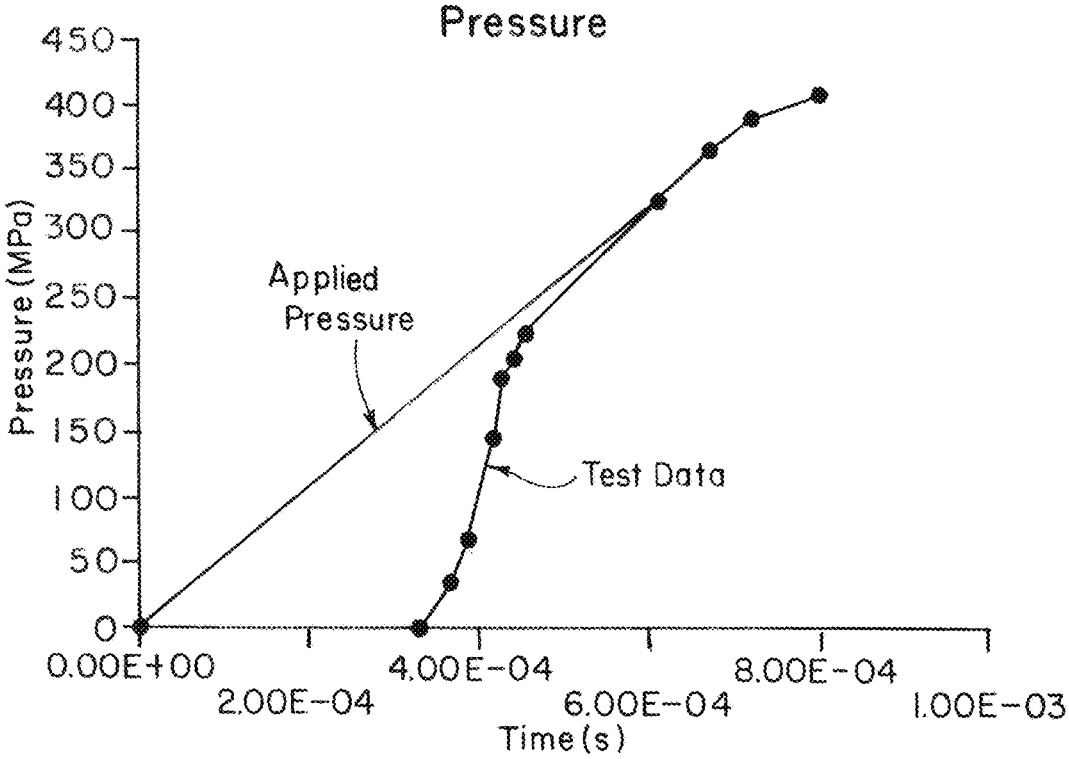

Plastic Strain v. Time

Plastic Strain Contour

POLYMER CARTRIDGE WITH ENHANCED SNAPFIT METAL INSERT AND THICKNESS RATIOS

CROSS-REFERENCE TO RELATED APPLICATIONS

This application is continuation of U.S. patent application Ser. No. 17/265,179 filed Feb. 1, 2021, which is a 371 National Stage of PCT/US2019/043743, filed Jul. 26, 2019, which claims priority to U.S. Provisional Patent Application No. 62/711,968, filed Jul. 30, 2018, which are hereby incorporated by reference in their entirety.

FIELD OF INVENTION

The present subject matter relates to ammunition articles with plastic components such as cartridge casing bodies, and, more particularly, a base insert used with the plastic cartridges.

BACKGROUND

It is well known in the industry to manufacture bullets and corresponding cartridge cases from either brass or steel. Typically, industry design calls for materials that are strong enough to withstand extreme operating pressures and which can be formed into a cartridge case to hold the bullet, while simultaneously resist rupturing during the firing process.

Conventional ammunition typically includes four basic components, that is, the bullet, the cartridge case holding the bullet therein, a propellant used to push the bullet down the barrel at predetermined velocities, and a primer, which provides the spark needed to ignite the powder which sets the bullet in motion down the barrel.

The cartridge case is typically formed from brass and is configured to hold the bullet therein to create a predetermined resistance, which is known in the industry as bullet pull. The cartridge case is also designed to contain the propellant media as well as the primer. However, brass is heavy, expensive, and potentially hazardous. For example, the weight of .50 caliber ammunition is about 60 pounds per box (200 cartridges plus links).

The cartridge case, which is typically metallic, acts as a payload delivery vessel and can have several body shapes and head configurations, depending on the caliber of the ammunition. Despite the different body shapes and head configurations, all cartridge cases have a feature used to guide the cartridge case, with a bullet held therein, into the chamber of the gun or firearm.

The primary objective of the cartridge case is to hold the bullet, primer, and propellant therein until the gun is fired. Upon firing of the gun, the cartridge case expands to seal the chamber to prevent the hot gases from escaping the chamber in a rearward direction and harming the shooter. The empty cartridge case is extracted manually or with the assistance of gas or recoil from the chamber once the gun is fired. Typically, the brass case has plastically deformed due to the high pressures leaving it larger than before it was fired.

One of the difficulties with polymer ammunition is having enough strength to withstand the pressures of the gases generated during firing. In some instances, the polymer may have the requisite strength, but be too brittle at cold temperatures, and/or too soft at very hot temperatures. Additionally, the spent cartridge is extracted at its base, and that portion must withstand the extraction forces generated from everything from a bolt action rifle to a machine gun. In bolt action weapons, the extraction forces are minimal due to the pressure having completely subsided prior to extraction and that extraction is performed by a manual operation by the shooter. Auto-loading semi automatic and fully automatic weapons operate in a different manner where some of the energy of the firing event is utilized to extract the spent case and either load the next in a closed bolt design or ready the bolt to load the next round by storing potential energy in a spring mechanism in a open bolt weapon.

The extraction and ejection of the cartridge are both a part of this firing routine, but are fundamentally different. Extraction deals with removing the spent casing from the chamber while ejection is the mechanism in which the spent case, once extracted, is removed from the weapon. Ejection is often accomplished with a spring in the bolt face which acts to propel the case in at an angle and direction to expel the casing. In other weapons systems, the case can be pushed out by a lever in the weapon that acts on the casing as it is being extracted rearward and provides a force that provides the required energy to expel the casing.

Since the base extraction point can be an area of failure, numerous concepts have developed to overcome the issues. Inventors like Daubenspeck, U.S. Pat. No. 3,099,958 have developed full metal inserts that are both overmolded (i.e. the polymer of the cartridge case is molded over the metal and undermolded (i.e. the polymer of the cartridge is molded inside the insert. This allows the insert to be added as part of the polymer molding process. Other references, illustrate inserts that are added to the cartridge after it is formed. In these instances, the metal insert is either friction fit or screwed on to the back of the cartridge case. See, U.S. Pat. No. 8,240,252.

In addition, both U.S. Pat. Nos. 8,240,252 and 9,188,412 disclose case wall thicknesses for polymer ammunition. Both only illustrate examples of case walls with thickness ratios between the neck and the case wall over 1.5. While discussing smaller ratios, there was no support for such a finding. Nor was it clear where the minimum thicknesses are measured from.

In addition, the '412 patent discussed conventional brass cartridge case dimensions. Again, while failing to identify the exact position for the measurements, the '412 patent provides the following:

Conventional Cartridge Case Dimensions

| Caliber | N | B | Ratio B/N |
|---|---|---|---|
| 5.56 mm | 11.5 | 7.5 | 0.65 |
| 7.62 mm | 15 | 13 | 0.87 |
| 50 BMG | 21 | 20 | 0.95 |

Units in 1/1000 of an inch, min wall for B(ody) and middle tolerance for N(eck)

This clearly illustrates that conventional brass cartridges have ratios less than 1.

While these solutions may function for isolated rounds or within certain weapons there is no way to determine what type of friction fit will function with all rounds and weapon systems. Hence a need exists for a polymer casing that can perform as well as or better than the brass alternative. A further improvement is the base inserts joined to the polymer casings that are capable of withstanding all of the stresses and pressures associated with the loading, firing and extraction of the casing.

SUMMARY

Thus, the invention includes a high strength polymer-based cartridge having a polymer case, with a first end having a mouth, a neck extending away from the mouth, the neck having a neck thickness (Tn), a shoulder extending below the neck and away from the first end, and a body formed below the shoulder and having a case thickness (Tc), The body can have a flat portion comprising a pull thickness (Tp), and a dip, closer to the shoulder than the flat portion and comprising a dip thickness (Tb). The body having a base interface portion 114. The base interface portion having a minimum thickness in both this section of the cartridge and the entire cartridge. The cartridge can also include an insert attached to the polymer case opposite the shoulder. In some examples the insert is metal or metal alloy. The insert can have a flat section contacting the flat portion and comprising an insert wall thickness (Ti), and a bulge engaging the dip to maintain the insert on the polymer case. Further, the cartridge has a projectile disposed in the mouth having a particular caliber.

In one example, the case thickness, the pull thickness, the dip thickness, and the insert wall thickness are related by Tp+Tb+Ti=Tc. These variables also have ranges where Tp equals approximately 15-33% of Tc, Tb is greater than or equal to Tp, and Tc is a function of the projectile and a ballistic performance for the projectile.

In one example, the neck thickness (Tn) and the dip thickness (Tb) are related by $1.0 \leq Tb/Tn \leq 1.5$ or just $<1.5$.

In another example, the ratio of the minimum thickness of the base interface portion to the neck thickness is between about 1.0 and about 1.5.

BRIEF DESCRIPTION OF THE DRAWINGS

The drawing figures depict one or more implementations in accord with the present teachings, by way of example only, not by way of limitation. In the figures, like reference numerals refer to the same or similar elements.

FIG. 3B is a side view of the body insert of FIG. 3A;

FIG. 3C is a cross-sectional view along line B-B of the cartridge body of FIG. 3B;

FIG. 4A is a magnified, exploded, cross-section view of the base interface portion and the case interface portion; and FIG. 4B is a magnified cross-sectional view of the base interface portion.

FIG. 5C is a magnified cross-sectional view of an example of the snap-fit region of the cartridge body of the invention;

FIG. 5D is a magnified view of the body snap-fit region;

FIG. 6A is a side view of the body insert in accordance with an example of the invention;

FIG. 6B is a cross-sectional view along line B-B of the cartridge body of FIG. 6A;

FIGS. 13A, 13B, 13C, and 13D are the four steps followed to simulate the firing for another example of the invention.

FIGS. 14A, 14B, and 14C illustrate the Nominal Geometry model variant, another example of the invention.

FIGS. 14D, 14E, and 14F illustrate the MaxMin model variant, another example of the invention.

FIG. 15 illustrates the adjustment of the applied pressure followed to simulate the firing for another example of the invention.

DETAILED DESCRIPTION

In the following detailed description, numerous specific details are set forth by way of examples in order to provide a thorough understanding of the relevant teachings. However, it should be apparent to those skilled in the art that the present teachings may be practiced without such details. In other instances, well known methods, procedures, and/or components have been described at a relatively high-level, without detail, in order to avoid unnecessarily obscuring aspects of the present teachings.

Figure 1:
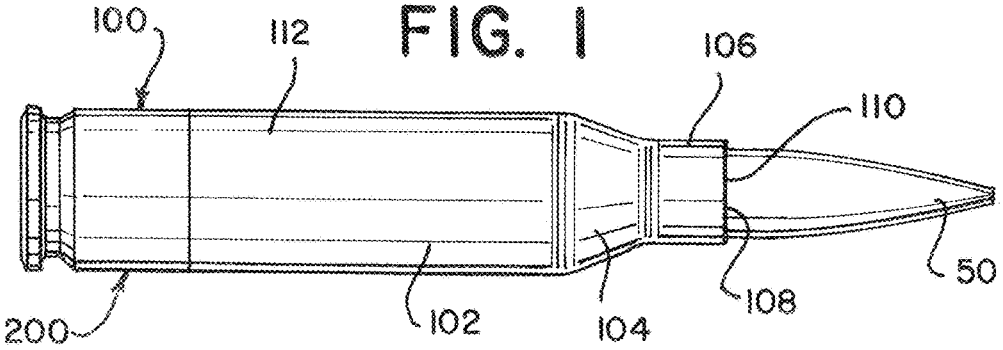
FIG. 1 is a side elevation sectional view of a bullet and cartridge in accordance with an example of the invention.

Referring now to FIG. 1, an example of a cartridge 100 for ammunition has a cartridge case 102 which transitions into a shoulder 104 that tapers into a neck 106 having a mouth 108 at a first end 110. The mouth 108 can be releasably connected to, in a conventional fashion, to a bullet or other weapon projectile 50. The cartridge case can be made from a plastic material, for example a suitable polymer. The rear end 112 of the cartridge case is connected to a base 200.

Figure 2A:
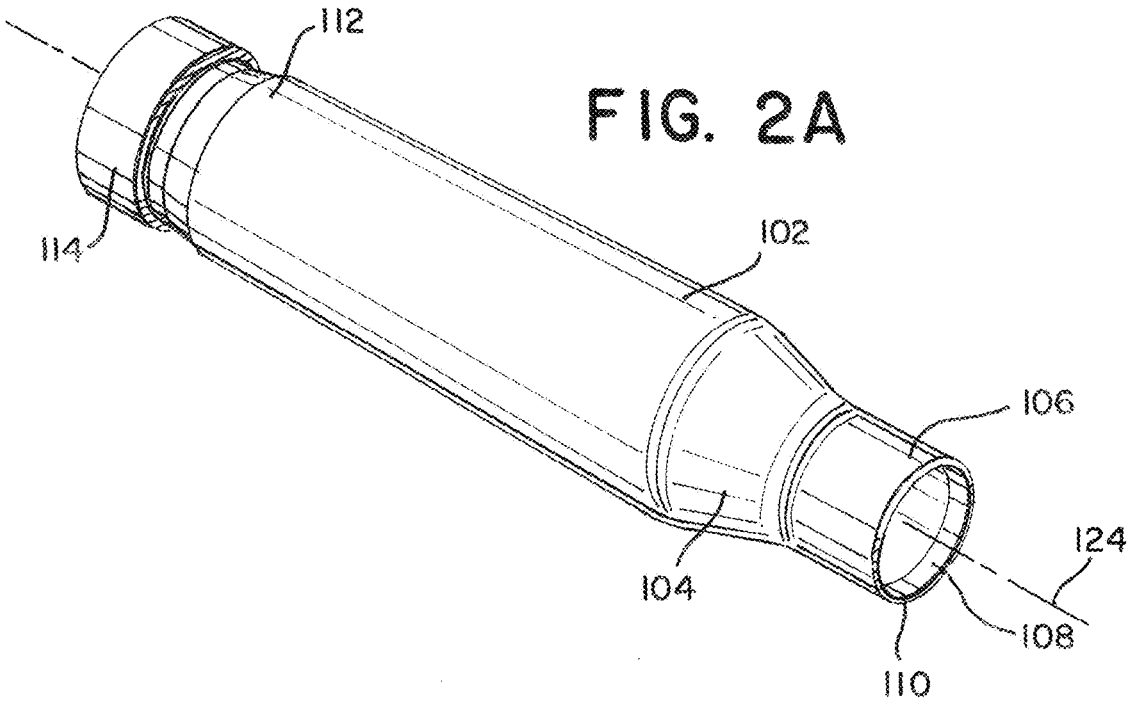
FIG. 2A is a perspective view of the cartridge body in accordance with an example of the invention.
Figure 2B:
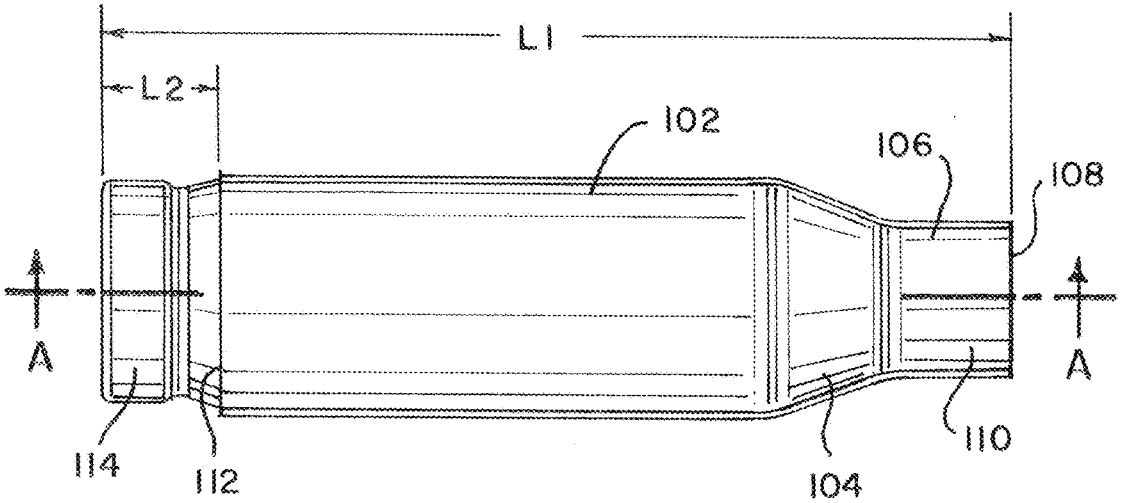
FIG. 2B is a side view of the cartridge body of FIG. 2A.
Figure 2C:
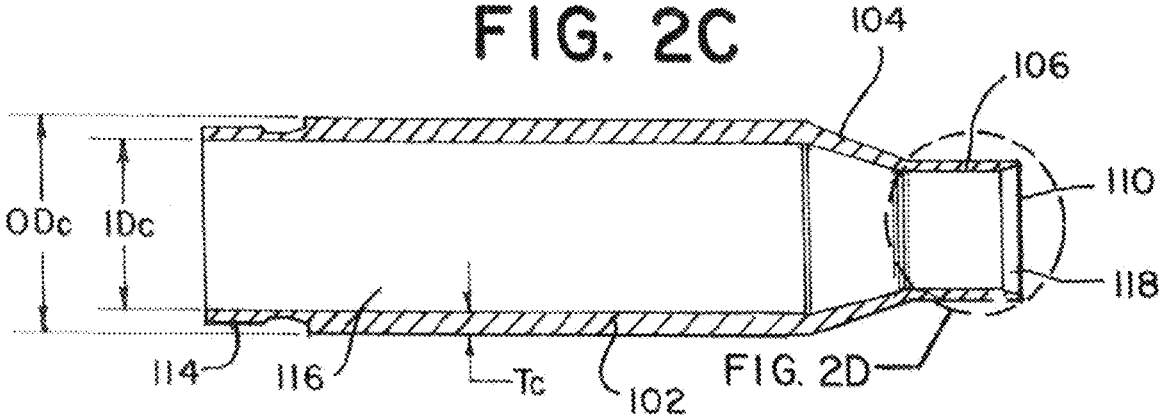
FIG. 2C is a cross-sectional view along line A-A of the cartridge body of FIG. 2B.

FIGS. 2A-2C illustrate the cartridge case 102 without the projectile 50 or base 200. FIGS. 2A-2C illustrate the base interface portion 114 positioned at the rear end 112 which provides the contact surface with the base insert 200. This is described in detail below. FIG. 2B illustrates that the case 102 from the front of the front end 110 to the rear of the rear end 112 has a length L1. The base interface portion 114 has a length L2.

FIG. 2C illustrates a cross-section of the case 102 along line A-A. Here, the majority of the case 102 forms a propellant chamber 116. The propellant is typically a solid chemical compound in powder form commonly referred to as smokeless powder. Propellants are selected such that when confined within the cartridge case 100, the propellant burns at a known and predictably rapid rate to produce the desired expanding gases. The expanding gases of the propellant provide the energy force that launches the bullet from the grasp of the cartridge case and propels the bullet down the barrel of the gun at a known and relatively high velocity. The volume of the propellant chamber 116 determines the amount of powder, which is a major factor in determining the velocity of the projectile 50 after the cartridge 100 is fired. The volume of the propellant chamber 116 can be decreased by increasing a case wall thickness Tc or adding an filler (not illustrated). The type of powder and the weight of the projectile 50 are other factors in determining projectile velocity. The velocity can then be set to move the projectile at subsonic or supersonic speeds.

Figure 2D:
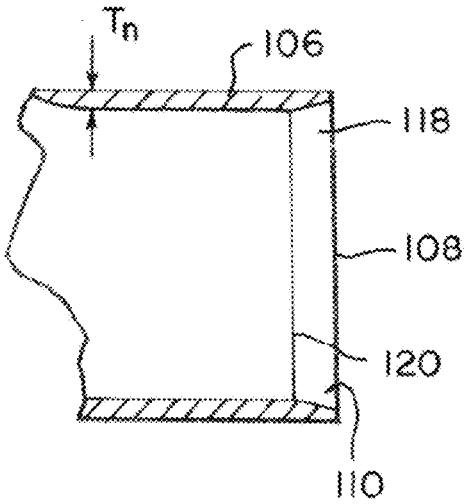
FIG. 2D is a magnified cross-sectional view of an example of the mouth of the cartridge body of the invention.

FIG. 2D is a magnified cross-section of the neck 106 and mouth 108. The neck 106 can have a thickness Tn. In this example, at the mouth 108 is a relief 118. The relief 118 is a recess cut into the neck 106 proximate the front of the front end 110. The relief 118 can be used to facilitate the use of an adhesive to seat the bullet 50. Even if the bullet 50 seats tightly in the neck 106, certain types of ammunition needs to be made waterproof. Waterproofing a round can include using a waterproof adhesive between the bullet 50 and the mouth 108/neck 106. The relief 118 allows a gap between the bullet 50 and the neck 106 for the adhesive to pool and set to make a tight, waterproof seal. The adhesive also increases the amount of tension necessary to remove the bullet 50 from the mouth 108 of the casing. The increase in both required push and pull force helps keep the bullet from dislodging prior to being fired. Alternatively, adjusting the pre-insertion inner diameter of the mouth of the case can be decreased to increase the amount of push and pull force to remove the bullet with limitations. As polymers are stressed and aged, a phenomenon known as creep occurs, which allows for permeant deformations and reduction in the stress. This phenomenon has the tendency to reduce the neck tension over time thus providing additional need for an adhesive to retain the projectile.

The relief 118 can be formed as a thinner wall section of the neck 106. It can be tapered or straight walled. If the relief 118 is tapered, the inner diameter will increase in degrees as it moves from the mouth 108 down the neck 106. Alternately, the relief 118 can be stair stepped, scalloped, or straight walled and ending in a shelf 120. Additionally, an example of the adhesive can be a flash cure adhesive that cures under ultraviolet (UV) light. Further, once cured, the adhesive can fluoresce under UV in the visual spectrum to allow for visual inspection. Additional flash cure adhesives can fluoresce outside the visual spectrum but be detected with imaging equipment tuned to that wavelength or wavelength band.

Figure 3A:
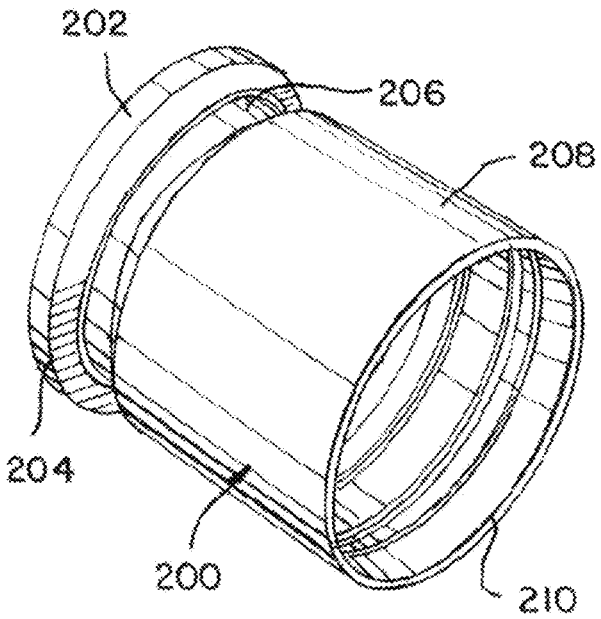
FIG. 3A is a perspective view of the body insert in accordance with an example of the invention.

FIGS. 3A-3C illustrate the base/insert 200 separate from the cartridge case 102 and the projectile 50. The base 200 has a rear end 202 with an enlarged extraction lip 204 and groove 206 just in front to allow extraction of the base 200 and cartridge 100 in a conventional fashion. An annular cylindrical wall 208 extends forward from the rear end 202 to the front end 210. FIG. 3C illustrates a primer cavity 212 located at the rear end 202 and extends to a radially inwardly extending ledge 214 axially positioned intermediate the rear end 202 and front end 210. A reduced diameter passage 216, also known as a flash hole, passes through the ledge 214. The cylindrical wall 208 defines an open ended main cavity 218 from the ledge 214 to open front end 210. The primer cavity 212 and flash hole 216 are dimensioned to provide enough structural steel at annular wall 208 and ledge 214 to withstand any explosive pressures outside of the gun barrel.

FIG. 3B illustrates the base length L3 from rear to front ends 202, 210. As will be described, only a portion of the base length L3 of the insert 200 engages with the base interface portion 114 along its length L2. The case interface portion 220 is shaped to interface with the case's 102 base interface portion 114. The case 102 and the base 200 are "snapped" or friction fit together. This occurs after both pieces are formed. The design can be as such to have the polymer base interface portion 114 "inside" the insert 200, i.e. the portion defined by length L2, and at that only the insert wall 208 is exposed. The insert 200, in this example, is not overmolded. Thus, the width W, or outer diameter, of the insert 200 approximately matches an outer diameter of the case 102 at that point (i.e., ODc) once assembled. The present invention includes a slightly oversized polymer body such that when the metal case expands during firing, that the polymer portion maintains its interlock.

FIG. 4A illustrates an exploded magnified view of an example of the case interface portion 220 and the base interface portion 114. Turning first to an example of the base interface portion 114, there is the flat portion 300 followed by a first slope 302. The base interface portion 114 then straightens out to dip 304 followed by a second slope 306, which can end in edge 308 before meeting the main wall of the case 102. As noted above, the case wall thickness Tc is the thickness of the wall and the outside of the wall forms the outer diameter of the entire cartridge 100. Thus, the wall thicknesses of the base interface portion 114 must be less than the case wall thickness Tc so when the base 200 is fit on, its wall 208 approximately matches the diameter of the cartridge 100.

The features on the case interface portion 220 generally mirror those on the base interface portion 114 so the two can connect. The insert 200 can have a flat section 400 leading to a first incline 402. At the end of the first incline 402 is a bulge 404 which is generally flat until the second incline 406 which then can end in a vertical tip 408. These features 400, 402, 404, 406, 408 in metal, particularly the first incline 402 and the bulge 404 can be used to keep the base 200 on the case 102. The flat section 400 can have a thickness Ti. The angle of 402 is important such that the angle must be steep enough to restrain the two components from separating. The Tp and the angle together determine the amount of resistance force. The present invention has a 60 degree angle, though a minimum of a 45 degree angle on feature 402 up to a maximum of 90 degrees is possible.

However, the reduced wall thicknesses of the base interface portion 114 can be points of failure since the polymer is the thinnest where most stresses occur during ejection of the round 100 after firing. Metal inserts, whether molded or friction fit, can fail in at least two ways. The two common ways are "pull-off" and "break-off." In a pull-off failure, the metal insert is pulled away from the polymer cartridge during extraction, thus the base is ejected, but the reminder of the cartridge remains in the chamber. The polymer is not damaged, just the bond between the metal and polymer failed and the base "slipped" off. In break-off failure, the polymer is broken, typically at the thinnest point, and the insert, along with some polymer, are ejected. Pull-off failure can occur in any type cartridge, while break-off failure is less common in reduced capacity polymer cartridges. Reduced capacity, e.g. subsonic polymer rounds, are already thickening the walls inside the cartridge, and can alleviate this issue. Break-off primarily occurs in supersonic or standard rounds where maximum capacity is an important factor and the wall thickness Tc is at its minimum.

To overcome these problems, the inventors have identified certain critical thicknesses that overcome pull-off and break-off failures. FIG. 4B illustrates the specific critical thicknesses in this example. The case 102 has a thickness Tc, which is typically the wall thickness of the propellant chamber 116 and the majority of the round 100 below the shoulder 104. The thinnest section of the the base interface portion 114 is thickness Tb, this is the thickness of the case wall at the dip 304. In the alternative, the thinnest section is the minimum thickness of the base interface portion 114. It is this thickness that dictates whether or not the insert 200 experiences break-off failure. The next critical thickness is Tp, which is the difference between a wall thickness Tf of the flat portion 300 and the dip thickness Tb. Thickness Tp can also be described as the depth of the dip 304 itself. This pull thickness Tp is a factor of whether or not the insert 200 can be pulled off during extraction. The larger pull thickness Tp, the deeper the dip 304 and thus more of the bulge 404 can act to withstand the extraction force.

There is a relationship between the angle of the first incline 402, insert 400 "hold" force and stress concentrating at that particular point. The smaller the angle of the first incline 402 the insert 400 has more movement or "wiggle room". This lowers the amount of stress that can be concentrated at point on the cartridge body. However, this weakens the pull resistance and the insert 400 is more likely to be pulled off during extraction. In contrast, as the angle of the first incline 402 increases, the more fixed the insert 400 is to the body, thus having greater pull-off strength. However, this now increases the amount of localized stress that is applied to the body by the insert. Thus, as the angle increases, the likelihood of break-off failure increases.

There is also a relationship between the dip thickness Tb and the pull thickness Tp. Thickening the dip thickness Tb to reduce the likelihood of break-off failure reduces the pull thickness Tp by making the dip 304 shallower, decreasing the bulge 404 penetration, and increasing the likelihood of pull-off failure. The converse is also true, increasing the pull thickness Tp thins the dip thickness Tb and makes break-off failure more common.

The inventor determined certain ratios of thicknesses to prevent both types of failure. The first relationship is that of the thickness of the cartridge 100 at the insert section:

$$Tb+Tp+Ti=Tc$$

Or, that the cumulative thickness of the dip thickness Tb, pull thickness Tp, and insert thickness Ti must equal the thickness of the case Tc so that there is a smooth outer cartridge wall for loading and extraction from the weapon's chamber. The proportions of the thicknesses Tb, Tp and Ti do not have to be equal, and the inventor determined optimal ranges for each in relation to Tc. In one example, the pull thickness Tp is between 15-33% Tc, the dip thickness Tb can be greater than or equal to the pull thickness Tp or, in a different example can be at least 20% of Tc. The insert thickness Ti can be the remainder of the sum of the pull and dip thicknesses Tp, Tb.

Additionally, one example can have the pull thickness Tp at approximately 0.010 inches or greater, while another example can have 0.005 inch. However, while more pull thickness Tp is helpful, there is a point of diminishing returns based on maximizing the size of the propellant chamber 116. Other examples range the pull thickness Tp between approximately 0.010-0.020 inches for a single snap design, a double snap design can drop the thickness to 0.005. Table 1 below sets out some experimental results:

TABLE 1

| | Thickness | | | | | |
|---|---|---|---|---|---|---|
| | .308 Winchester | | .50 Cal | | 6.5 mm SOCOM | |
| | Inch | % Tc | Inch | % Tc | Inch | % Tc |
| Tp | 0.010 | 21.739 | 0.010 | 16.667 | 0.010 | 22.222 |
| Tb | 0.016 | 34.783 | 0.035 | 58.333 | 0.010 | 22.222 |
| Ti | 0.020 | 43.478 | 0.015 | 25.000 | 0.025 | 55.556 |
| Tc | 0.046 | | 0.060 | | 0.045 | |

There can be limits to how thick and thin certain elements are. The cartridge and the firearm chambered for that cartridge have to function together. For consistency throughout the industry and the world, dimensions of the cartridge case and the firearm chambers for a particular caliber are very tightly dimensionally controlled. A variety of organizations exist that provide standards in order to help assure smooth functioning of all ammunition designed for a common weapon. Non-limiting examples of these organizations include the Sporting Arms and Ammunition Manufacturers' Institute (SAAMI) in USA, the Commission Internationale Permanente pour l'epreuve des armes a feu portatives (CIP) in Europe, as well as various militaries around the globe as transnational organizations such as the North Atlantic Treaty Organization (NATO).

SAAMI is the preeminent North American organization maintaining and publishing standards for dimensions of ammunition and firearms. Typically, SAAMI and other regulating agencies will publish two drawings, one that shows the minimum (MIN) dimensions for the chamber (i.e. dimensions that the chamber cannot be smaller than), and one that shows the maximum (MAX) ammunition external dimensions (i.e. dimensions that the ammunition cannot exceed). The MIN chamber dimension is typically larger than the MAX ammunition dimension, assuring that the ammunition round will fit inside the weapon chamber. However, and counterintuitively, some chambers actually have a tolerance stackup that provides a crush condition wherein the cartridge MAX is actually larger than the chamber MIN. These and all published SAAMI, NATO, US Department of Defense (US DOD) and CIP drawings are incorporated here by reference.

It is important to note that SAAMI compliance and standardization is voluntary. SAAMI does not regulate all possible calibers, especially those for which the primary use is military (for example, .50 BMG (12.7 mm) calibers are maintained by the US DOD), or the calibers which have not yet been submitted (wildcat rounds, obscure calibers, etc.)

Additionally, the inventors have identified certain thickness ratios. FIG. 2D illustrates one of the specific thicknesses in this example. The neck 106 has a thickness Tn. FIG. 4B illustrates the other specific thicknesses in this example. The thinnest section of the base interface portion 114 is thickness Tb, this is the thickness of the case wall at the dip 304.

There is a relationship between the dip thickness Tb and neck thickness Tn that can be defined by:

$$1.0 \leq Tb/Tn \leq 1.5$$

The ratio of Tb to Tn includes, but is not limited to ratios of 1.00, 1.05, 1.10, 1.15, 1.20, 1.25, 1.30, 1.35, 1.40, 1.45, and 1.50.

Additionally, the relationship between the dip thickness Tb and neck thickness Tn that can also be defined by:

$$1.0 \leq Tb/Tn \leq 1.5$$

The ratio of Tb to Tn includes, but is not limited to ratios of 1.00, 1.05, 1.10, 1.15, 1.20, 1.25, 1.30, 1.35, 1.40, 1.45.

In another embodiment, the base interface portion 114 has a minimum thickness. The thinnest section is the minimum thickness of the base interface portion 114. The inventors have identified certain thickness ratios relating to the minimum thickness of the base interface portion 114. The neck 106 has a thickness Tn. The base interface portion 114 having a minimum thickness.

There is a relationship between the minimum thickness of the base interface portion and the neck thickness. The ratio of the minimum thickness of the base interface portion to the neck thickness is between about 1.0 and about 1.5. The ratio includes, but is not limited to, ratios of 1.00, 1.05, 1.10, 1.15, 1.20, 1.25, 1.30, 1.35, 1.40, 1.45, and 1.50.

The inventors note that these ratios are larger than in standard brass cases that have ratios between 0.65 and 0.95. This notes some of the inherent differences between using polymer and metal cartridges. Further, ratios larger than 1.5 have been identified in polymer cases but these ratios add increased thickness, and thus weight, unnecessarily to the cartridge. While these weight difference are minute for individual cartridges, there is a cumulative effect as ammunition is typically shipped in bulk and carried in significant quantities by solders in the field. Further these thicknesses can affect the snap fit of the metal insert to the cartridge body proper.

Turning back to FIG. 2C, the propellant chamber 116 has an average outer wall diameter ODc and an average inner wall diameter IDc. The outer and inner diameters ODc, IDc dictate the cartridge wall thickness Tc and the inner wall diameter IDc can affect the volume of the propellant chamber. Particular cartridges for particular caliber projectiles have standard outside dimensions so the cartridge outer diameter ODc is fixed. In a military specified cartridge and caliber, the specifications typically call for maximum projectile performance, one main factor of which is projectile speed. Specifications also dictate a chamber pressure, so as to not over pressure and destroy the weapon. For example, for a 7.62 caliber round, the specification calls for an average projectile speed of 2750±30 fps at an average chamber pressure of 57,000 psi. Fixing the maximum cartridge outer diameter ODc and the ballistic specifications, then dictate the volume of the propellant chamber 116 to allow enough powder to meet those requirements. This leads to, at best, very small reductions in the inner diameter IDc to balance all of these factors.

The present invention contemplates all of the factors of standard outside dimensions, maximizing powder chamber dimensions to maximize projectile performance, pull-off failure, break-off failure and manufacturing tolerance for the case and insert. Thus, for any cartridge having matching ballistic requirements, the outer case diameter ODc is set, the inner case diameter IDc can be approximated by the amount of powder for given performance, and the present invention can then be used to size the base interface portion 114 and the case interface portion 220.

Using the above concepts, the base 200 and the case 102 can be friction fit together and withstand the forces necessary during loading, firing, and extraction of the cartridge 100, with no added adhesive at the rear 112 of the case 102 required. This friction fit is also typically water resistant. However, additional water proofing may be required for extreme uses. In one example of the present invention, a sealant 450 is applied only to the first incline 402 before the base 200 and case 102 are assembled. The sealant 450 does not coat the second slope/incline 206, 306 or the dip/bulge 304, 404. In one example, as the base 200 is forced over the base interface portion 114, the bulge 404 keeps the sealant 450 away from the case 102 until it enters the dip 304. Now, the sealant 450 is smeared under pressure along the flat portion/section 300, 400. This keeps the metal/polymer interface for the friction fit. In another example, as the bulge 404 slides over the flat portion 300 and flat section 400, at least the trailing edge of the sealant 450 is smeared across the flat portion 300 so that when the bulge 404 finally engages the dip 304, the sealant 450 is generally smeared across and interfaces between the flat portion 300 and flat section 400.

Figure 5A:
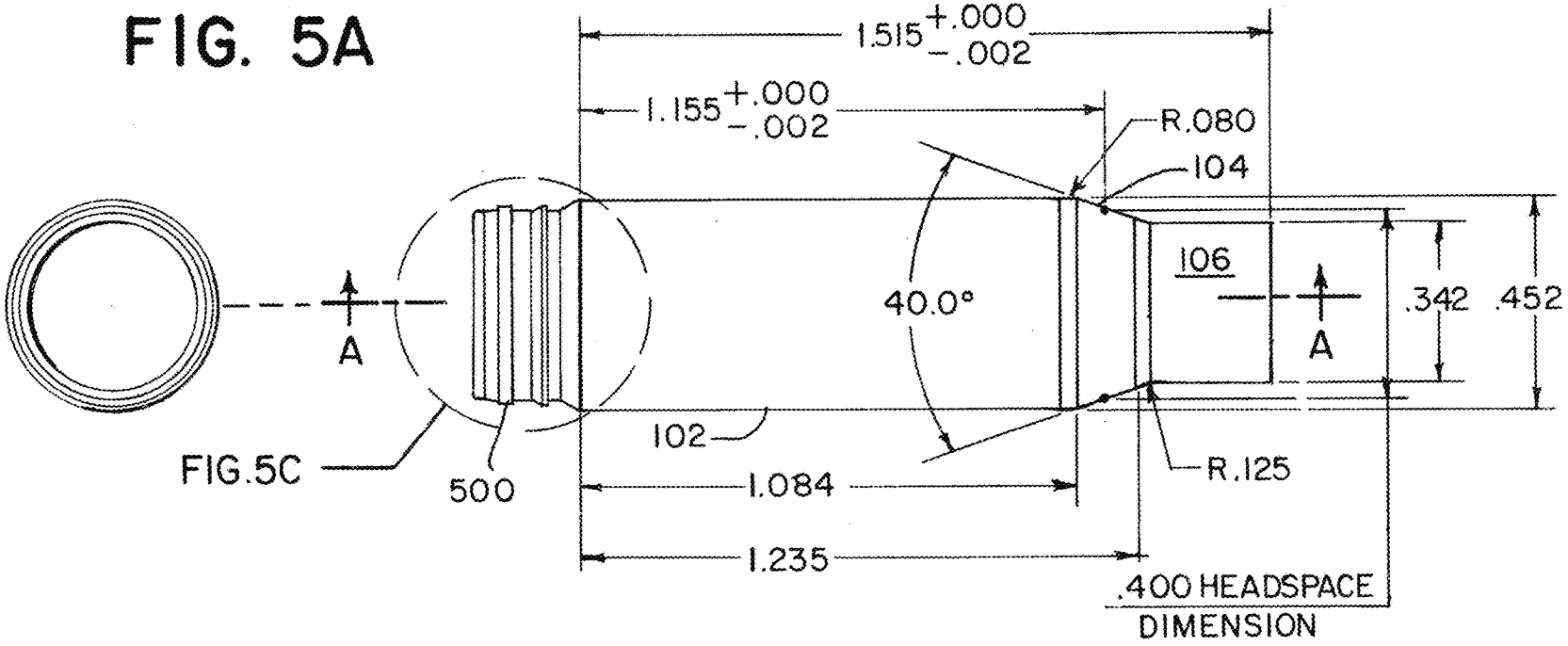
FIG. 5A is a side view of the cartridge body in accordance with an example of the invention.
Figure 5B:
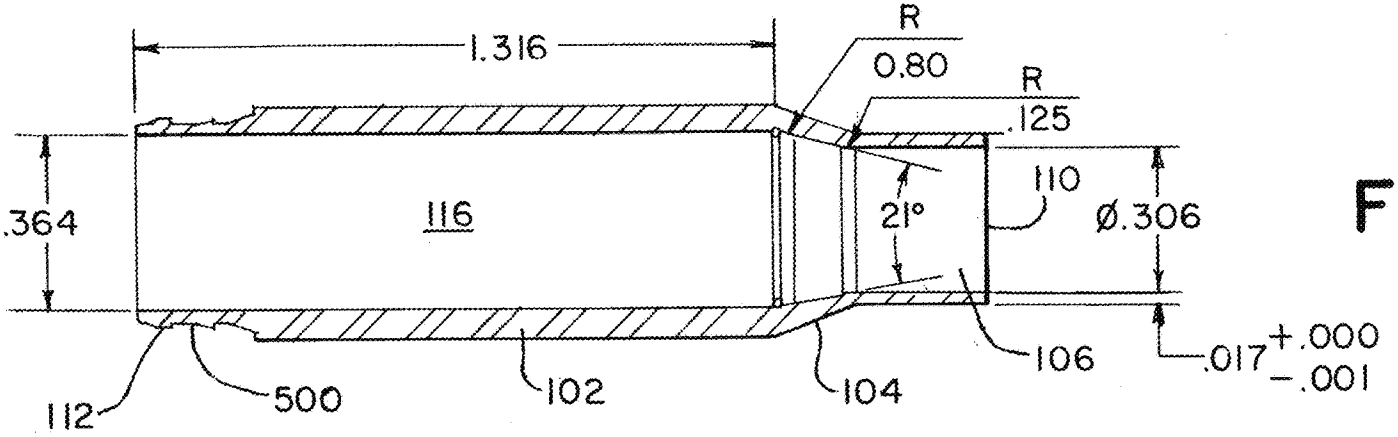
FIG. 5B is a cross-sectional view along line A-A of the cartridge body of FIG. 5A.

FIGS. 5A-5D illustrate another example of the cartridge case 102 without the projectile 50 or insert 200. FIGS. 5A, 5C, and 5D illustrate another example of a body snap-fit region 300 positioned at the rear end 112 which provides the contact surface with the base insert 200. This is described in detail below. FIG. 5B illustrates a cross-section of the case 102 along line A-A. Here, the majority of the case 102 forms a propellant chamber 116, as discussed above.

The body snap-fit region 500 on the rear end 112 of the body has two sets of ridges 502, 510 to engage the insert 200. As opposed to a single snap-fit/interface, region, this example of the body snap-fit region 500 can absorb additional torque that certain weapons produce in their cartridge ejection systems. For example, the M240 machine gun's ejection system applies approximately 5 times the ejection force of an AR style semi-automatic rifle and can over torque the insert 200 when extracting the cartridge 100, leading to the insert 200 being pulled from the body 102, leading to jamming. This additional torque produced by the ejector can cause the case to flex during extraction. This flex can lead to jamming of the firearm.

The ejector portion of the firearm is a small plunger that uses compressed spring energy rotate the case from the firearm after extraction to provide for ejection of the spent cartridge 100 from the weapon. The ejector acts on the face 240 of the insert 200 and is depressed when the cartridge 100 is loaded, the ejector extends to rotate the case once it is free of the chamber. At the point in the process at which the cartridge 100 is almost free of the chamber, the maximum case flex occurs as the ejector acts on the insert 200, yet the body 102 of the cartridge 100 is still restrained by the chamber. Due to the two-piece design of the present cartridge 100, this force can cause the joint between the body 102 and the insert 200 to be stressed beyond its limits. At this point, one of several failure modes can occur depending on the design of the joint. If the joint is not sufficiently rigid, the insert 200 can be pried from the case body 102 either partially or fully removed. When partially removed, the cartridge 100 is able to flex enough during extraction to allow the ejector plunger to partially or fully extend while the case body 102 is still constrained by the chamber. When this occurs, the ejector no longer has enough energy to quickly expel the spent cartridge 100 allowing it to remain in the weapon and cause a jam loading the next round. If the joint is sufficiently rigid yet the case body 102 is not strong enough, a fracture can occur causing either the insert 200 to be partially or fully separated from the case body 102. A partially separated insert 200 can lead to the same failure to eject as a partially removed insert 200. A fully separated insert 200 can be ejected from the weapon yet leave the case body 102 within the weapon also leading to a jam condition. In order for the cartridge 100 to be properly ejected, it must remain sufficiently rigid and strong throughout the process. Due to the nature of plastics, case flex is more likely to occur at elevated temperatures where polymers are more ductile, while fractures are more likely at low temperatures where the polymer is more rigid and brittle. High speed video was used to observe the phenomenon so that proper analysis and corrective actions could be made.

To compensate, an example of the present invention now can include a lower snap ridge 502 proximate the second end 112 in combination with an upper snap ridge 510, both formed on the polymer body 102. The lower snap ridge 502 has a lower snap length 504. This length 504 is measured along a vertical axis 124 of the cartridge 100 (see FIG. 2A). This is formed closest to the rear end 112 of the body 102 and its position and dimensions can be modified for each particular size cartridge based on at least the caliber of the projection 50 being fired. A lower snap first edge 506 can be proximal the second end 112 and can be sloped. This slope can be approximately 15° and can facilitate the insert 200 being slid onto the body 102. A lower snap second edge 508 can be farther from the second end 112 than the lower snap first edge 506, i.e. the other edge of the ridge 502. The lower snap second edge 508, in examples can be sharp, and can be set at approximately at 90°. Setting this edge 508 at a sharp angle provides additional strength however, the trade-off is that more localized stress can occur at the snap. This was accommodated for by adding a second snap which divides the stress between to two points and over a longer distance.

The second snap-fit, or interference, region is an upper snap ridge 510 closer to the first end 110 than the lower snap ridge 502. The upper snap ridge 510 has an upper snap length 512 shorter than the lower snap length 504 (e.g., 504>512). Also, as with the lower snap region 502, an upper snap first edge 514 can be proximal the second end 112 and can have a slope which can be approximately 15°. An upper snap second edge 516 farther from the second end 112 than the upper snap first edge 514 can be sharp as well. In some examples, be set at approximately 90°.

The above combination of features can provide increased strength and pull resistance. This can be shown in FIGS. 8A and 8B where a single snap with less than 90 degree back side had a max deflection force of approximately 12 lbs while the improved two snap design allowed for a max deflection force of approximately 35 lbs. This testing was done using a fixture design to approximate the forces as they are applied by a spring loaded ejector with a case partially extracted from a chamber. In addition, FEA (Finite Element Analysis) was performed to validate the design and showed very similar results (see, FIGS. 11A, 11B and 25 discussed below). The length difference (e.g., 504>512) facilitates the engagement of the insert 200. As noted below, the insert snap-fit region 600 can be dimensioned to mirror the body snap fit region 500. As the first (upper) set of snap-fit regions 510, 514, 516 start to pass over each other, the smaller-in-length upper regions 510, 514, 516 cannot engage with the larger-in length lower regions 502, 506, 508, preventing the insert 200 from being "half-snapped". Additionally, the use of approximately 90° edges 508, 516 provides to a more positive engagement between the body and insert snap regions 500, 600.

Figure 6C:
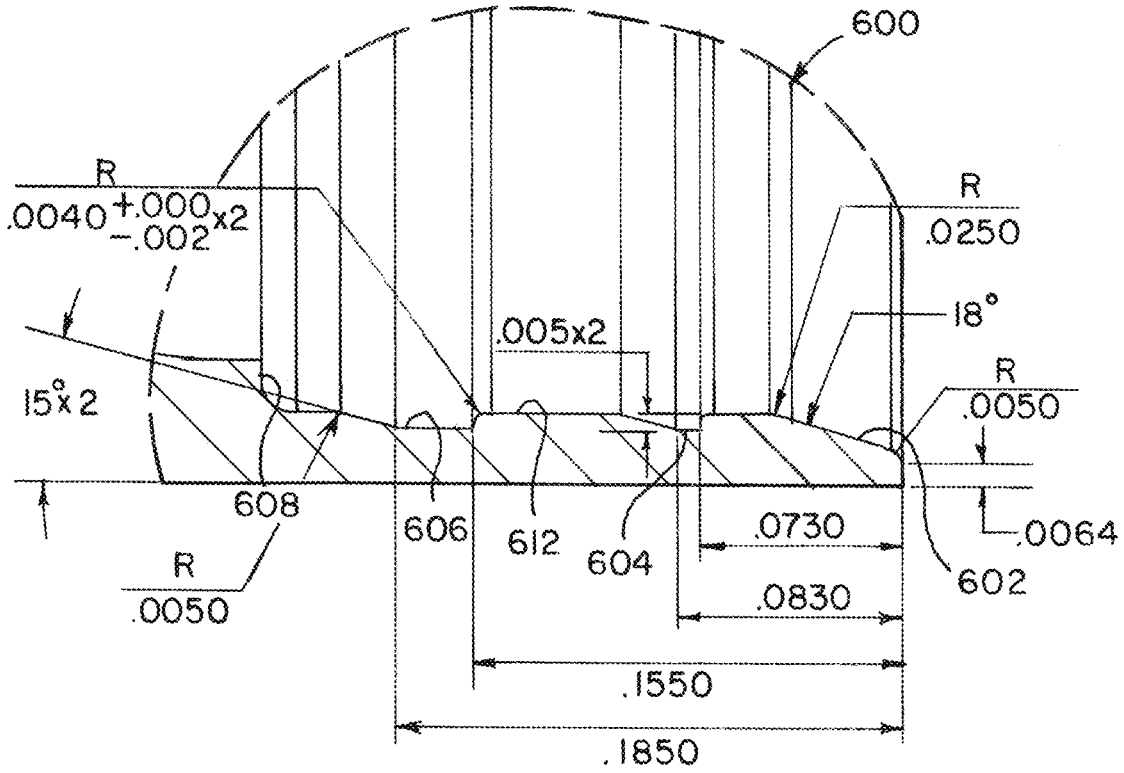
FIG. 6C is a magnified cross-sectional view of an example of the insert snap-fit region of the cartridge body of the invention.

Turning now to FIGS. 6A-6C, the insert 200 can have an insert double snap-fit region 600 with a leading edge 602 opposite the rim 206. The leading edge 602 can be sloped, radiused, or both. This slope can be approximately 18°, in one example. The sloped leading edge 602 can smooth the initial transition as the insert 200 is fit onto the body 102. The leading edge 602, once the insert 200 is fully engaged with the body 102, can act as a failure point since the metal edge can "dig" into the polymer body if moved out of plane. Rounding the edge of the leading edge 602 can lower that stress. An insert upper recess 604 can be approximately dimensioned to receive the upper snap-fit region 510, 512, 514, 516 and an insert lower recess 606 can be approximately dimensioned to receive the lower snap-fit region 502, 504, 506, 508. Once the body and insert regions engage, the insert 200 is snapped-on and the cartridge 100 can be loaded with powder and projectile 50 and discharged.

The insert 200 can further include a shoulder 608 disposed between the flash hole 216 and the insert snap fit region 600 that can contact the polymer case second end 112. Again, this minimizes the edge contact that can be stress points.

In one example, the body snap-fit region 500 has a body snap-fit diameter 518 and the insert snap-fit region 600 has an insert snap-fit diameter 610 approximately less than the body snap-fit diameter 518. Since the insert snap-fit region 600 engages over the body snap-fit region 500, this means that, in one example an average inner diameter 610 of the insert snap-fit region 600 is smaller than an average outer diameter 518 of the body snap fit region 500. In different examples, the diameters can be taken from the smallest point, the largest point, or an average over some or all of the regions 500, 600. The body snap-fit diameter 518 and the insert snap-fit diameter 610 can both be taken from the same points (e.g., both from the smallest point) or differing points depending on the design and caliber. Said differently, the case 102 can be pre-loaded in compression thus allowing for permanent plastic expansion of the metal insert 200 during firing while keeping the mechanical, interference lock from disengaging.

Figure 7:
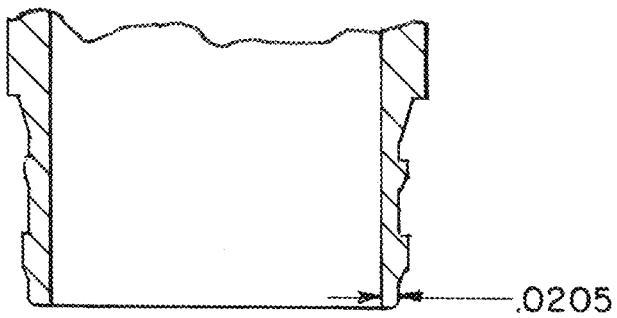
FIG. 7 is a magnified cross-section view of the body snap-fit region.

In another example, the body snap-fit region 500 further comprises a body spacer region 520 between the lower snap ridge 502 and the upper snap ridge 510. The insert snap-fit region 600 can have a matching insert spacer region 612. FIG. 7 illustrates, again in detail and dimensions of one example of the double snap regions of the case body 102.

Figure 8A:
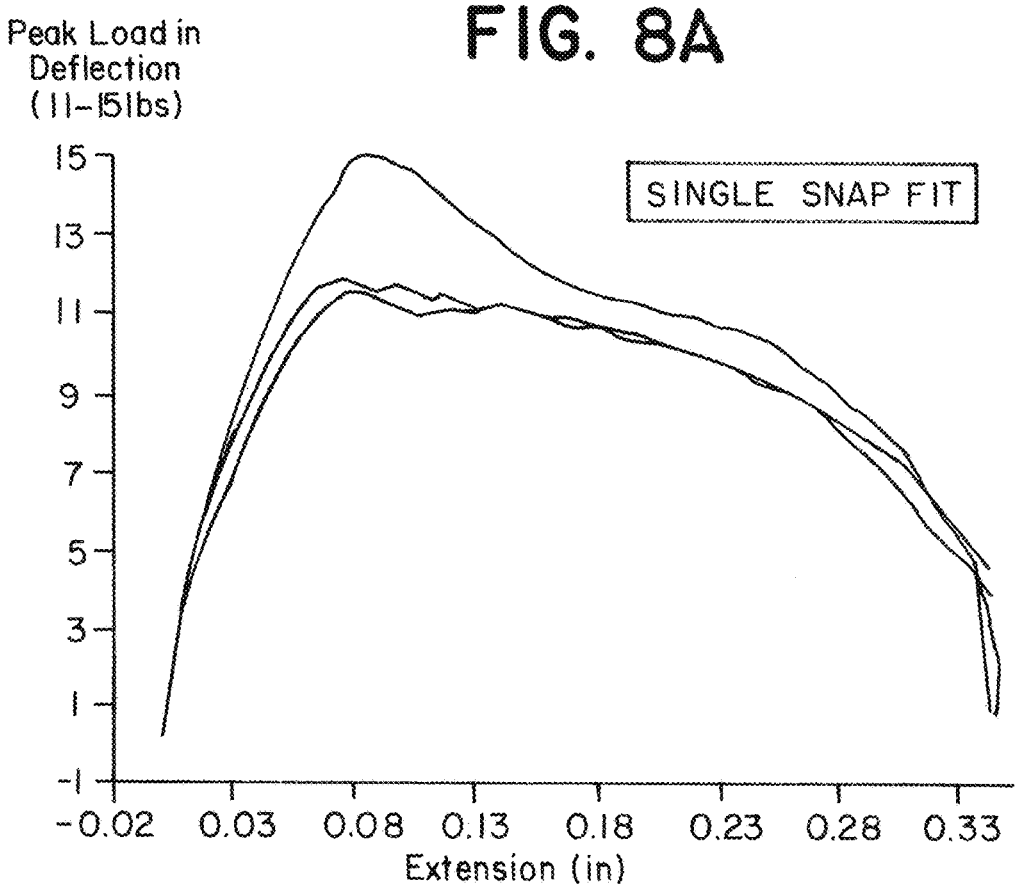
FIG. 8A is a graph of insert deflection vs. peak load for a single snap example of the invention.
Figure 8B:
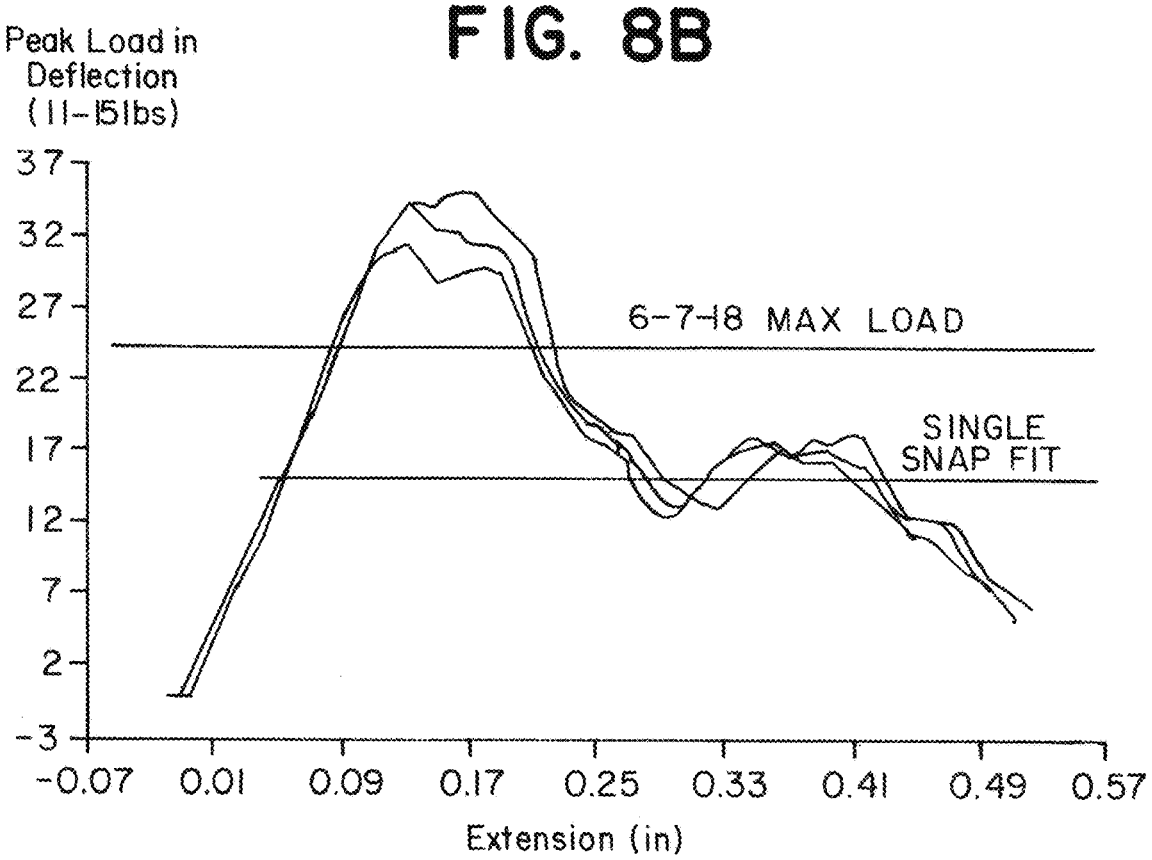
FIG. 8B is a graph of insert deflection vs. peak load for a double snap example of the invention.

Turning now to FIGS. 8A and 8B, they illustrate the insert deflection vs. peak load. FIG. 8A illustrates the single snap design over a number of identical trials to come to a mathematical average. Here it can be seen that for a particular loading how far the insert can deflect/extend from the body. Under a single-snap example, the peak load is between 11 and 15 pounds of force before the insert fails. FIG. 8B illustrates the same features for a double-snap design. Here the peak deflection load is between 32 and 37 pounds. The increased deflection force can mitigate the stresses placed on the cartridge during extraction, especially with certain weapon systems, including the M240 machine gun.

Figure 9A:
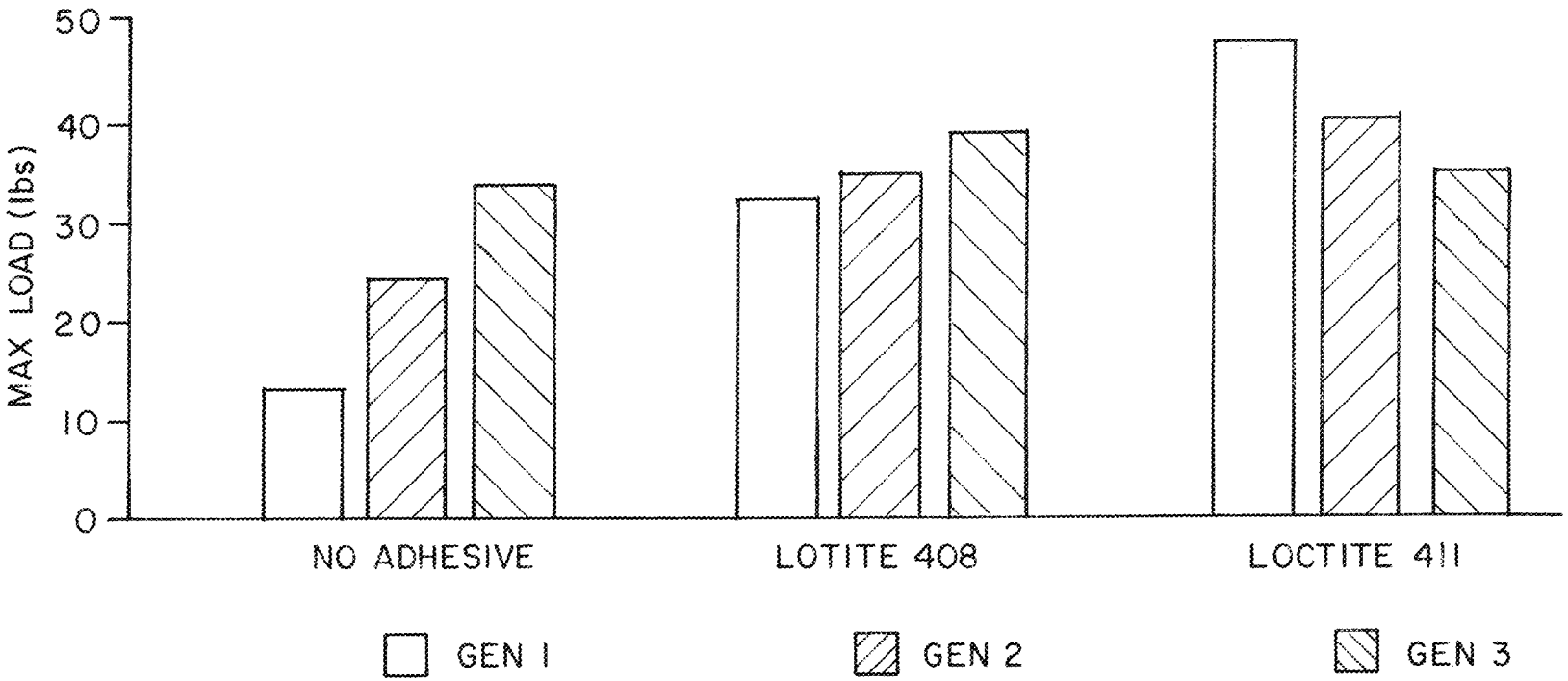
FIG. 9A is a bar chart comparing the max load in cantilever testing for another example of the invention.
Figure 9B:
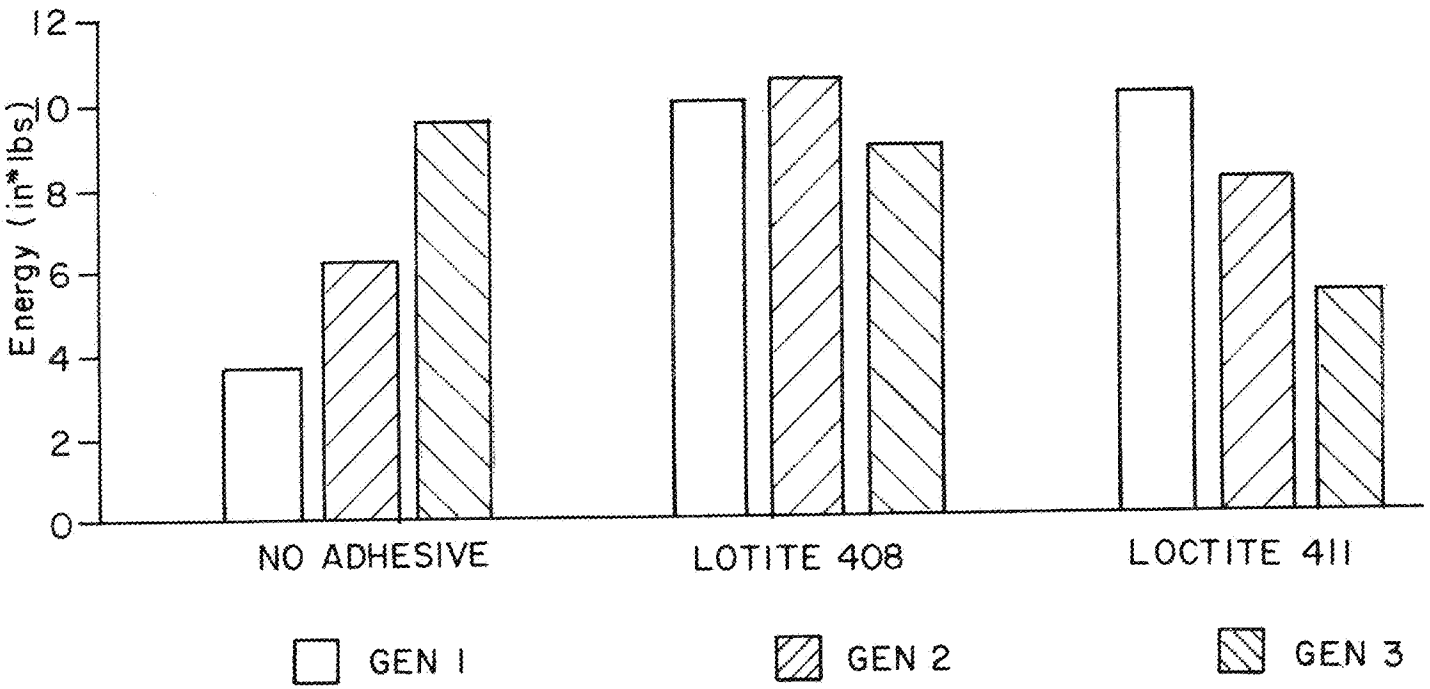
FIG. 9B is a bar chart comparing the energy (in.*lbs.) in cantilever testing for another example of the invention.

FIGS. 9A and 9B compare maximum load and cantilever energy over examples of single and double snap-fits and the use of different adhesives to mitigate separation issues during extraction. "Gen 1" is a single snap-fit design while "Gen 2" and "Gen 3" are double snap-fits. The "Gen 2" being an early variant of the "Gen 3". Loctite® is a brand of adhesive, and "408" and "411" are variants. These are just examples of adhesive used and other adhesives can be used. FIG. 9A is a bar chart comparing the max load in cantilever testing for another example of the invention while FIG. 9B is a bar chart comparing the energy (in.*lbs.) in cantilever testing for another example of the invention. Without adhesive the "Gen 3" double snap-fit can withstand the maximum load and energy. This is helpful, as the addition of adhesive can increase the cost of a cartridge in both material, time and handling. Sometimes, however, as noted above, adhesive is added no only to add additional bonding strength, but to also act as a water seal. A cartridge sealed both at the insert and mouth can be watertight enough to keep the powder in the propellant chamber 116 dry if the cartridge is immersed.

For purposes of developing an understanding of the casing strains during assembly, firing, and extraction a preliminary finite element analysis of one example of the invention was done. The results of the analysis are subject to change as a result of the mesh convergence analysis, material model parameter sensitivity, and validation analyses using specific validation test data from real specimens. The scope of the work was to perform a stress analysis of an idealized example of the invention.

Figure 10A:
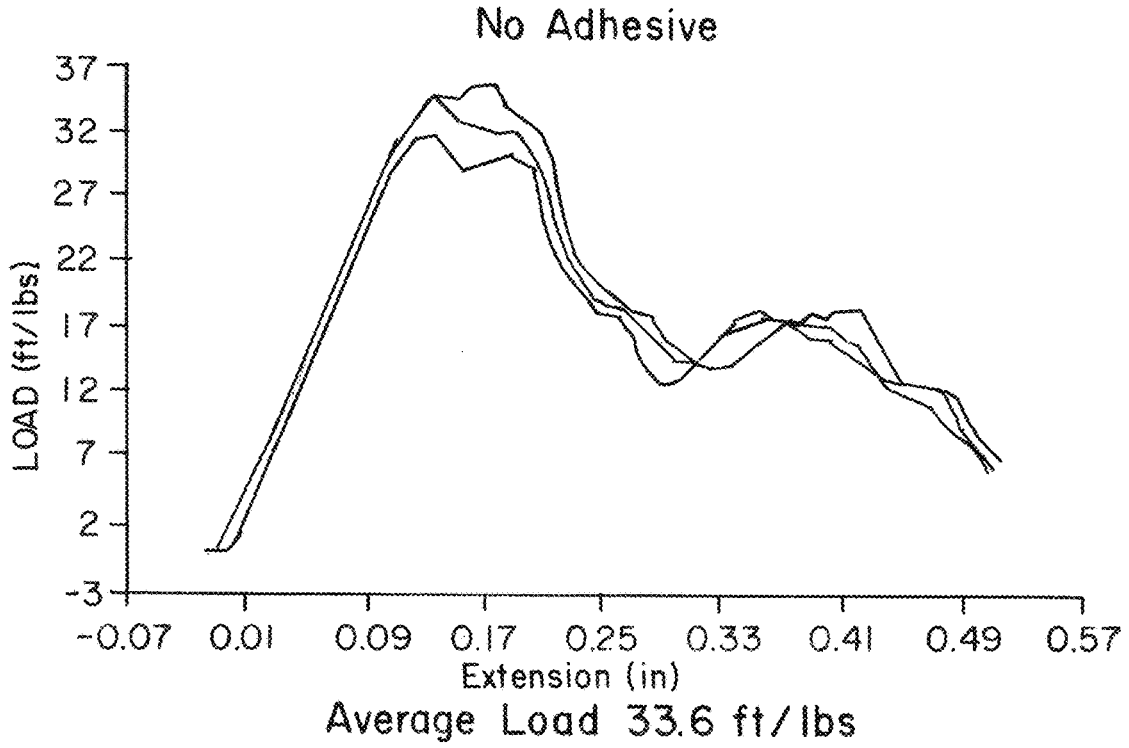
FIG. 10A is a graph of the load in cantilever testing with no adhesive for another example of the invention.
Figure 10B:
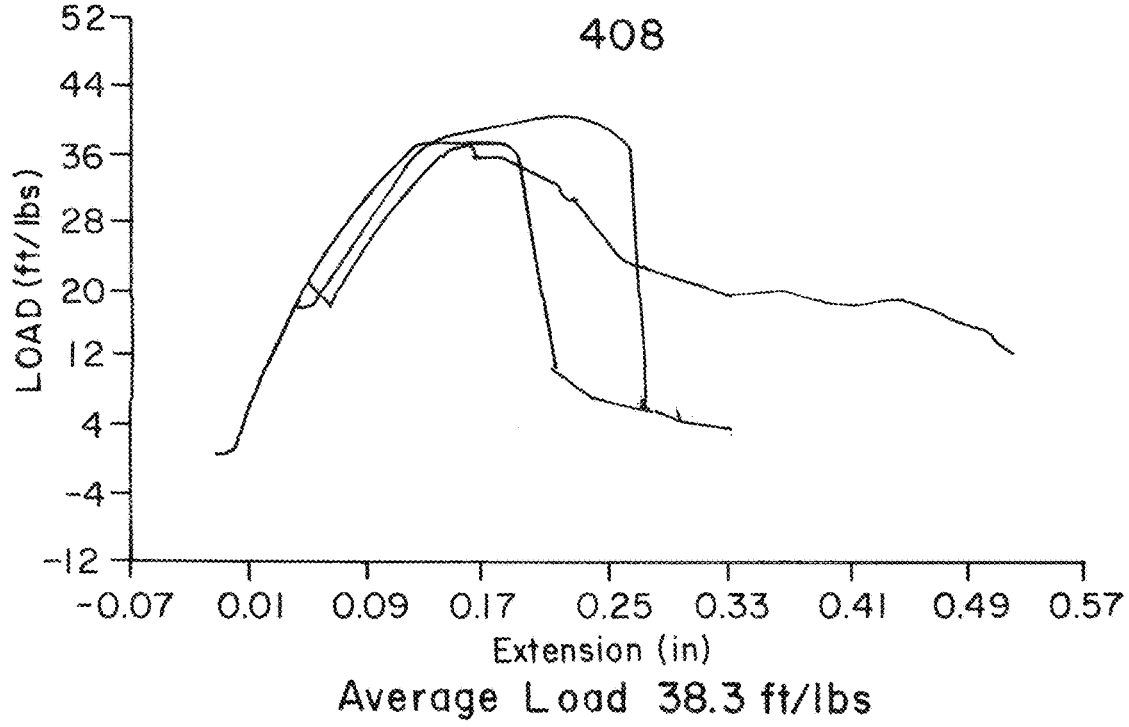
FIG. 10B is a graph of the load in cantilever testing with 408 adhesive for another example of the invention.
Figure 10C:
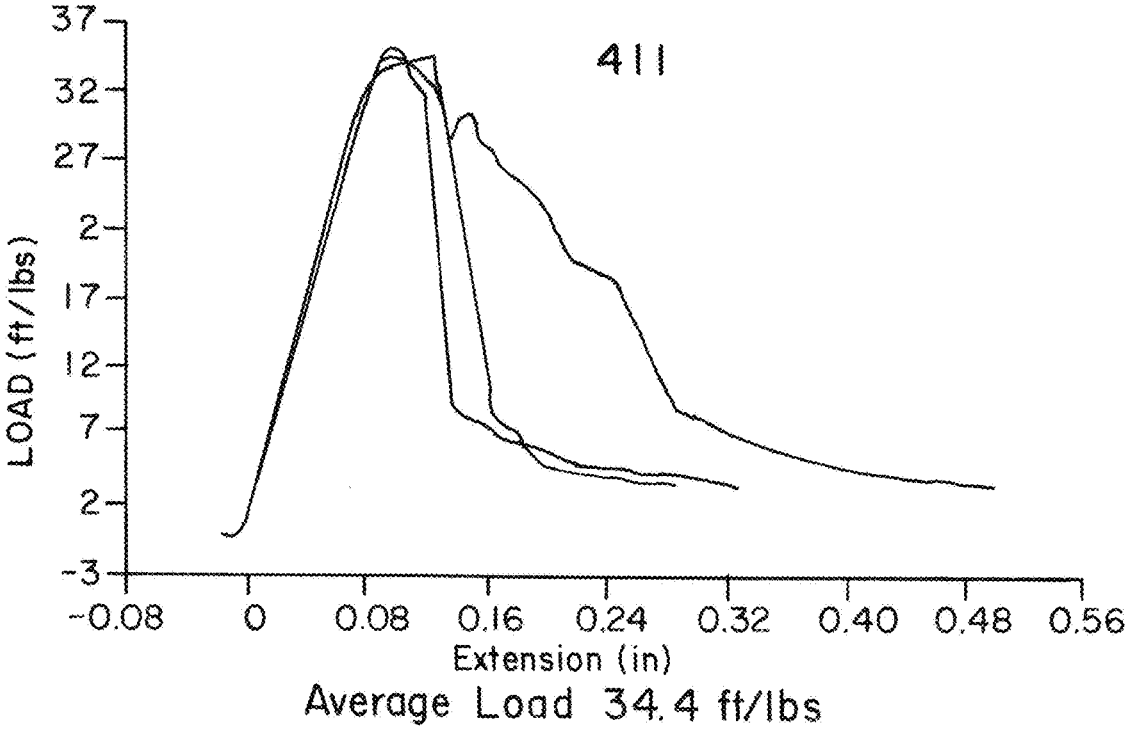
FIG. 10C is a graph of the load in cantilever testing with 411 adhesive for another example of the invention.

FIGS. 10A-10C illustrate graphs of a double-snap design of the present invention under cantilever load with no adhesive and two other adhesives. FIG. 10A is a graph of the load in cantilever testing with no adhesive and the average load is 33.6 ft./lbs. FIG. 10B is a graph of the load in cantilever testing using the 408 adhesive and the average load is 38.3 ft./lbs. While FIG. 10C is a graph of the load in cantilever testing with the 411 adhesive and the average load is 34.4 ft./lbs. From both the bar and line graphs, one of skill in the art can see that not adhesives function the same and sometimes the straight friction fit is superior to the addition of adhesives. As above, the different lines indicate tests on identical cartridges.

Figure 11A:
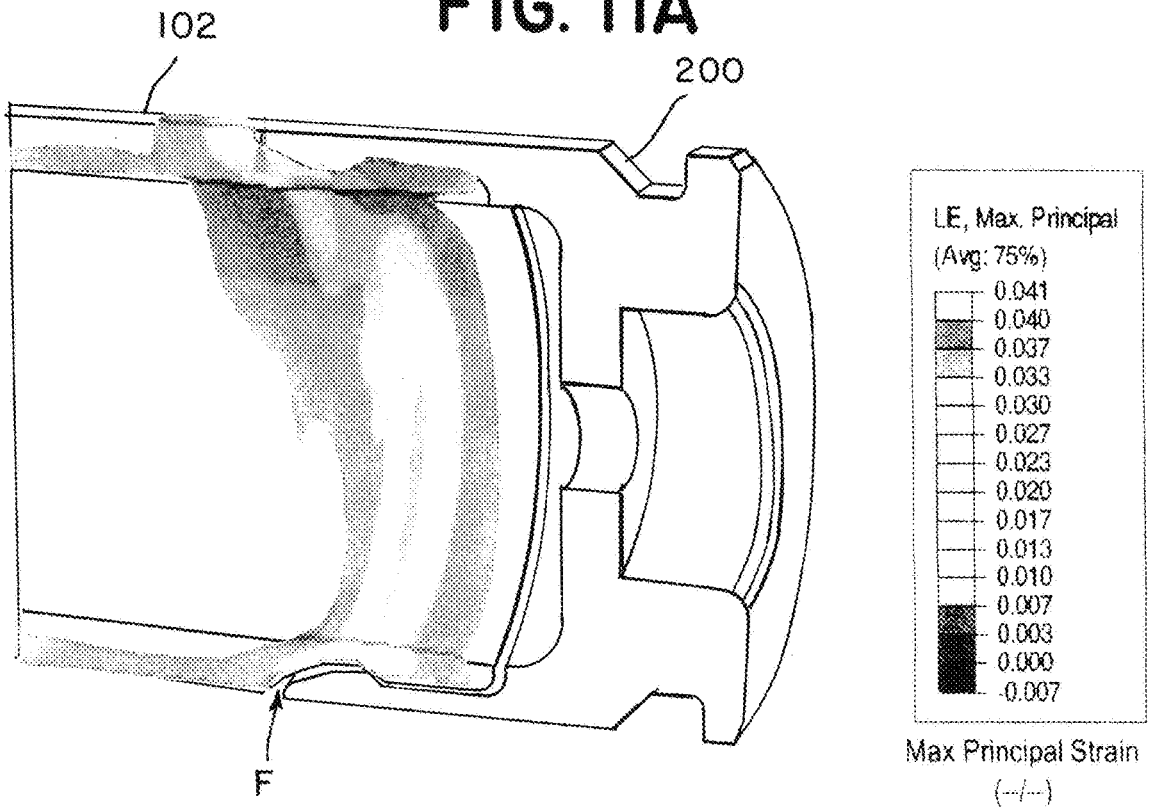
FIG. 11A is a simulation of the strains during extraction at ~1200 N-mm at 296K for another example of the invention.
Figure 11B:
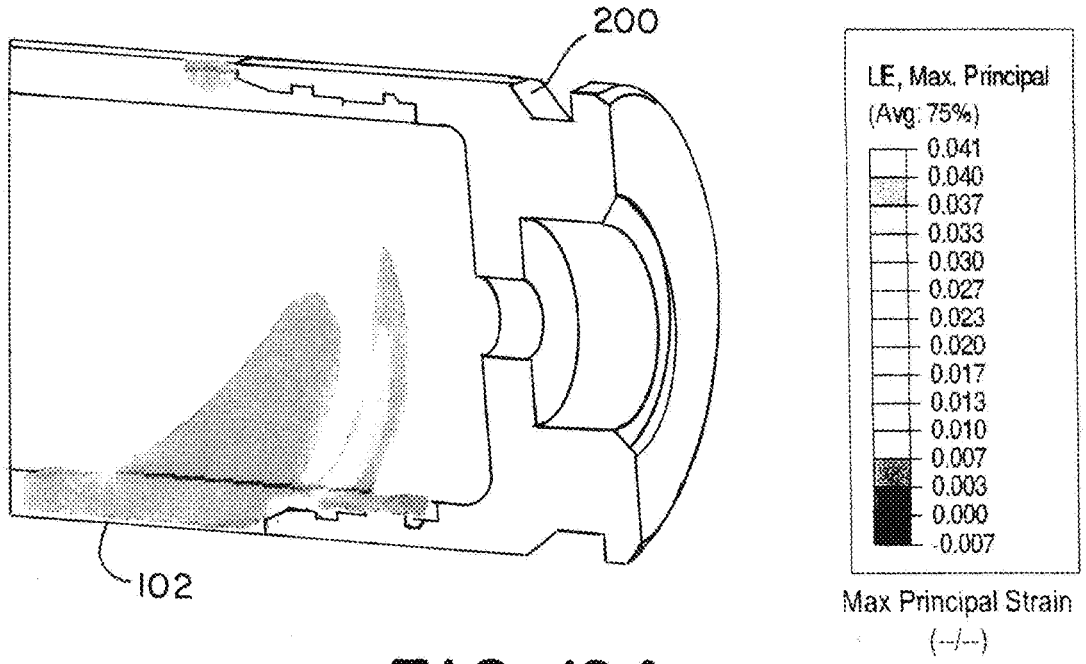
FIG. 11B is a simulation of the strains during extraction at ~1200 N-mm at 296K for another example of the invention.

FIGS. 11A and 11B are extraction strain simulations for the single snap (FIG. 11A) and double snap (FIG. 11B) designs. The insert 200 in the single snap design can be seen to slip from the body 102 at the tip (point F) due to high strain. However, the double-snap design minimizes the strain between the insert 200 and the body 102 during extraction, and the insert 200 is not separating from the body 102. These tests were taken at the same temperature (ambient), which as discussed above and further below, can change the nature of the polymer.

Figure 12A:
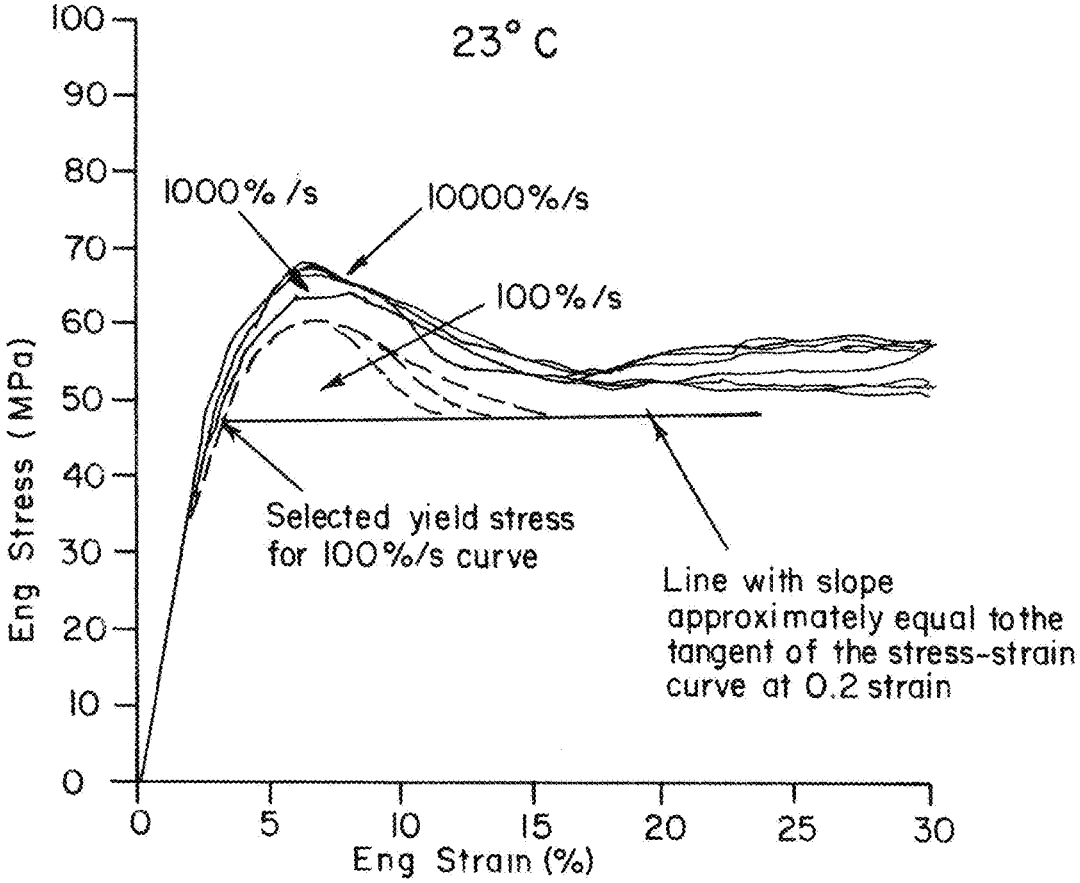
FIG. 12A is a graph illustrating the location of the experimental yield stress.
Figure 12B:
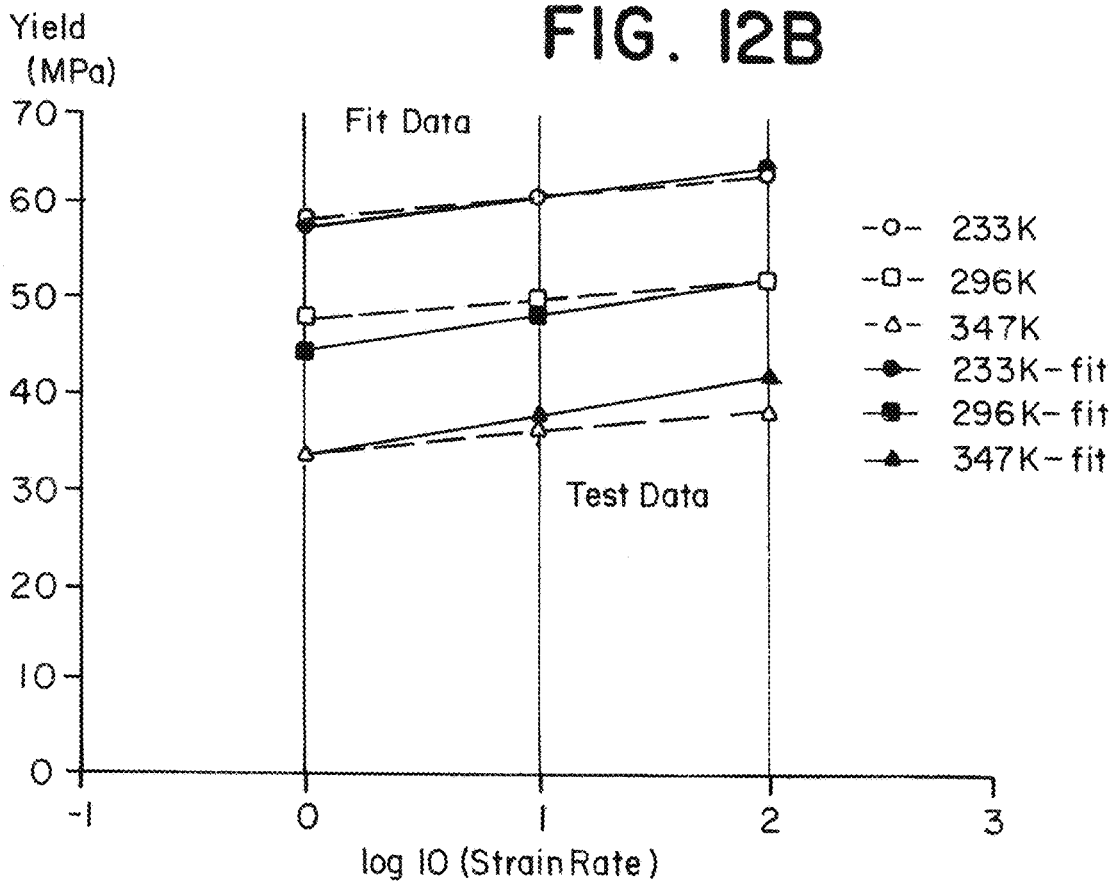
FIG. 12B is a graph of the fit of the material model to experimental yield stress data.

FIG. 12A is a graph illustrating the location of the experimental yield stress. The experimental yield stress was identified from the intersection of the initial loading path with the tangent of the stress-strain curve at ~20% strain. This data is taken at 23° C., 74° F. or ~296K (also sometimes referred to as "ambient" testing). The operating temperature ranges for military grade ammunition can range from −65° F. to 165° F. (−54° C. to 74° C.). FIG. 12B is a graph of the fit of the material model to experimental yield stress data. Here strain data is fit over the range of operating temperatures from 233K to 347K (−40° C. to 74° C.).

Figure 13A:
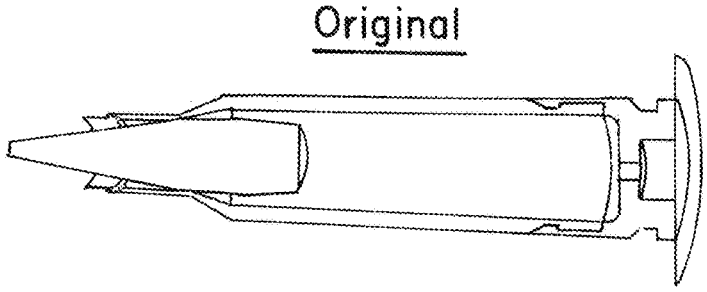
Figure 13B:
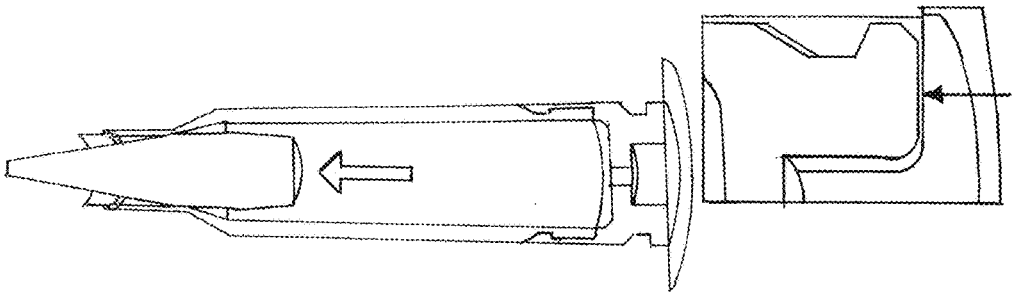

FIGS. 13A, 13B, 13C, and 13D are the four steps followed to simulate the firing cycle for analysis of another example of the invention. FIG. 13A illustrates the first step to simulate the firing—the "original" location is the "empty" cartridge without the projectile 50 friction fit into the neck. FIG. 13B illustrates the second step to simulate the firing—the "load bullet" step. Here the projectile 50 is inserted into the case mouth, which is interference fit, giving rise to stresses that are present prior to firing and need to be considered for accurate modelling. FIG. 13C illustrates the third step to simulate the firing—the "load chamber" step. FIG. 13D illustrates the fourth steps to simulate the firing—the "pressurize" step or the firing of the round.

FIGS. 14A, 14B, and 14C illustrate the Nominal Geometry model variant, another example of the invention. FIG. 14A is a close-up of the bullet or other weapon projectile 50 and the cartridge 100 of the Nominal Geometry model. FIG. 14B illustrates the entire cartridge in the simulated chamber. FIG. 14C illustrates the tolerance gap in the design dimensions. The insert and cartridge body lie almost flat to each other and there is a slight gap between the two at the tip of the insert.

FIGS. 14D, 14E, and 14F illustrate the MaxMin model variant, another example of the invention. FIG. 14D is a close-up of the bullet or other weapon projectile 50 and the cartridge 100 of the MaxMin model. FIG. 14E illustrates a cross-section of the entire cartridge in the simulated chamber, now under pressure as the firing pin/extractor acts on the face of the insert.

FIG. 14F illustrates that under certain dimensional tolerance the insert can now "ride up" on the body, increasing the diameter of the round at that point. This can cause increased stress at the insert/body interface, increasing the likelihood of break-off failure. Maintaining a near seamless interface minimizes the strain at the interface.

FIG. 15 illustrates the adjustment of the applied pressure followed to simulate the firing for another example of the invention. The applied pressure was adjusted to better simulate an unknown portion of initial pressure.

Figure 16A:
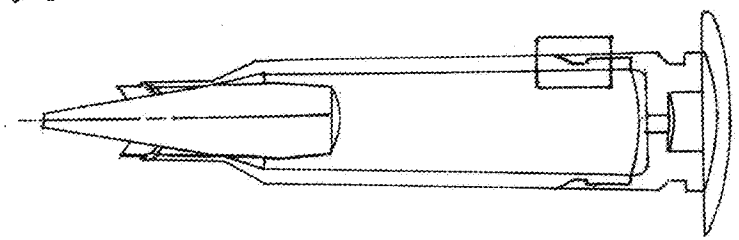
FIG. 16A is a graph of the plastic strain of the Nominal Geometry variant at 347K.
Figure 16A:
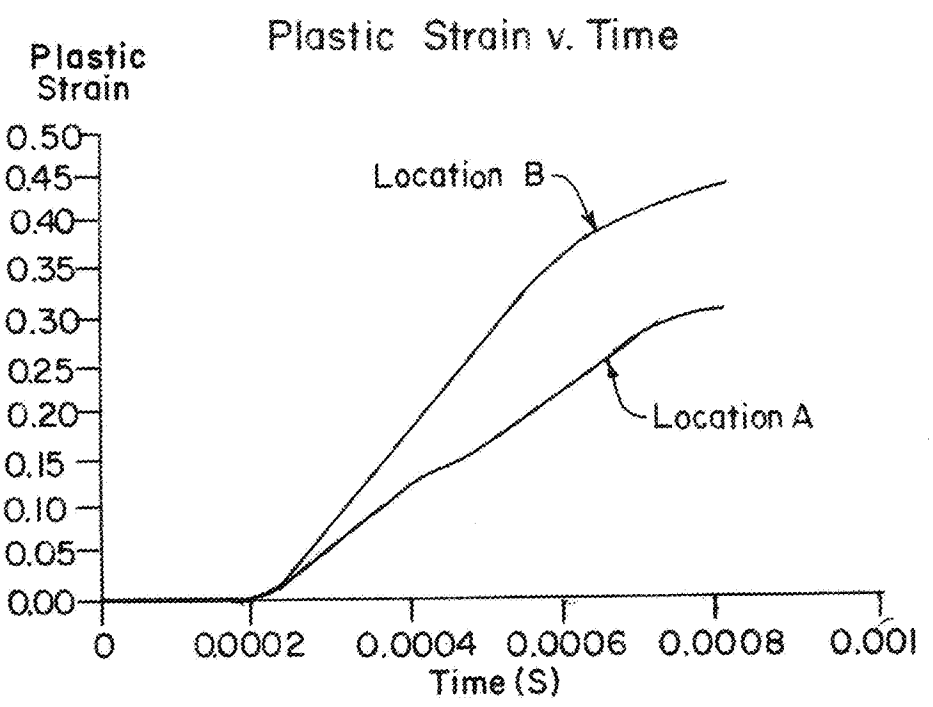
Figure 16A:
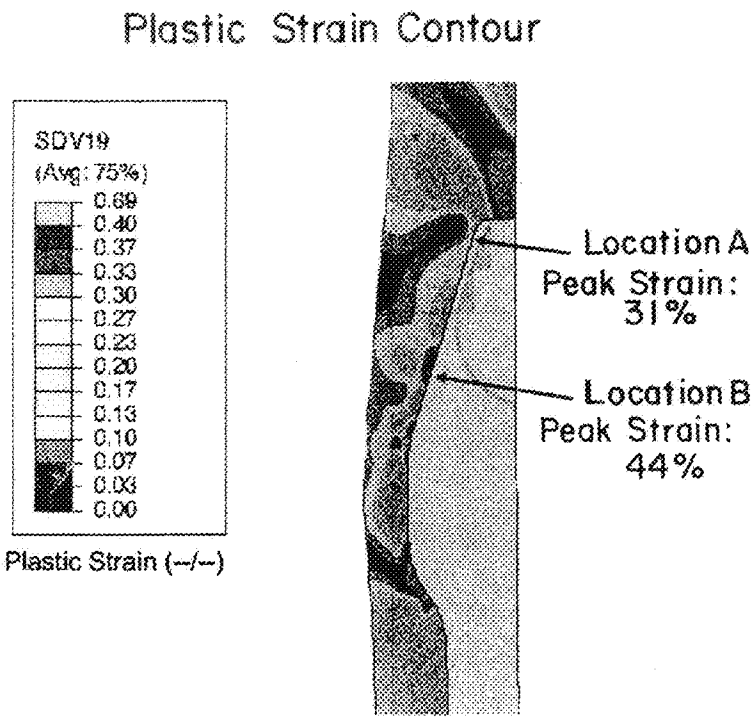
Figure 16B:
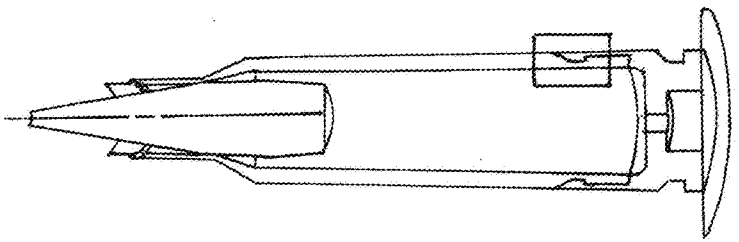
FIG. 16B is a graph of the plastic strain of the Nominal Geometry variant at 296K.
Figure 16B:
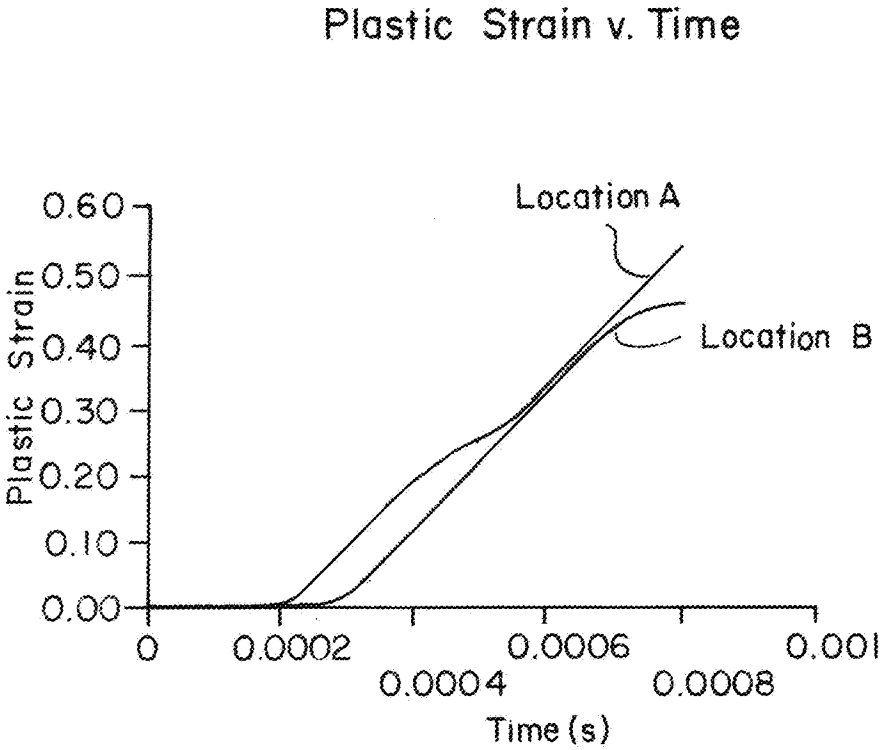
Figure 16B:
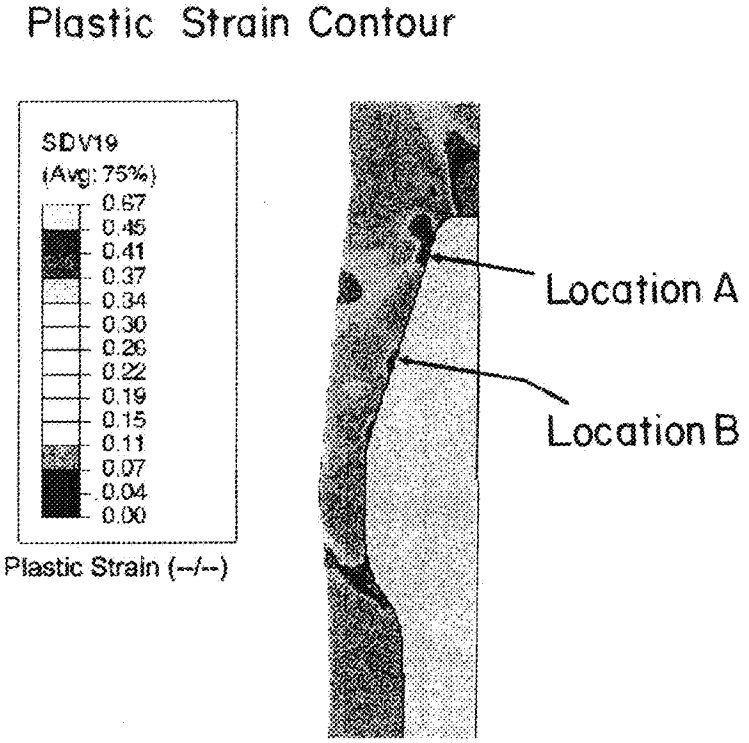
Figure 16C:
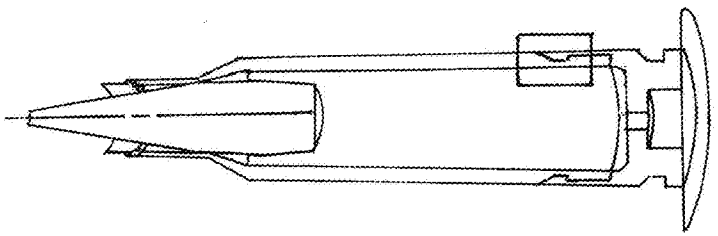
FIG. 16C is a graph of the plastic strain of the Nominal Geometry variant at 233K.
Figure 16C:
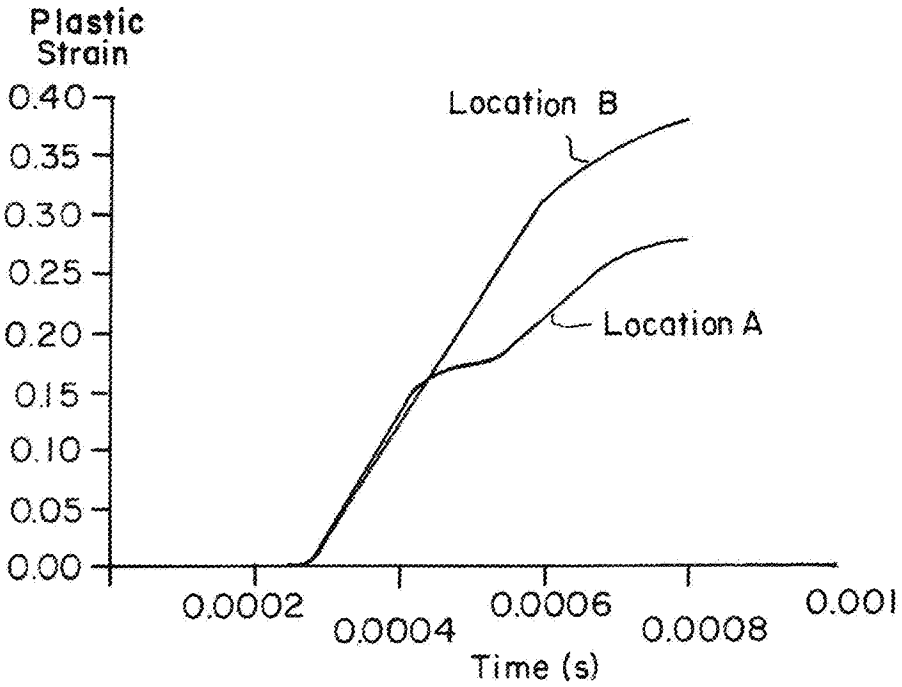
Figure 16C:
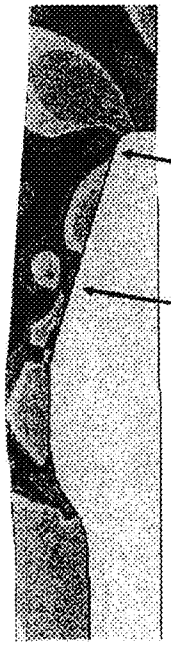
Figure 16C:
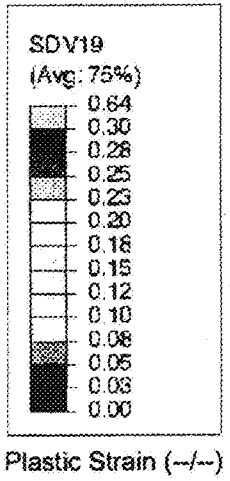
Figure 17A:
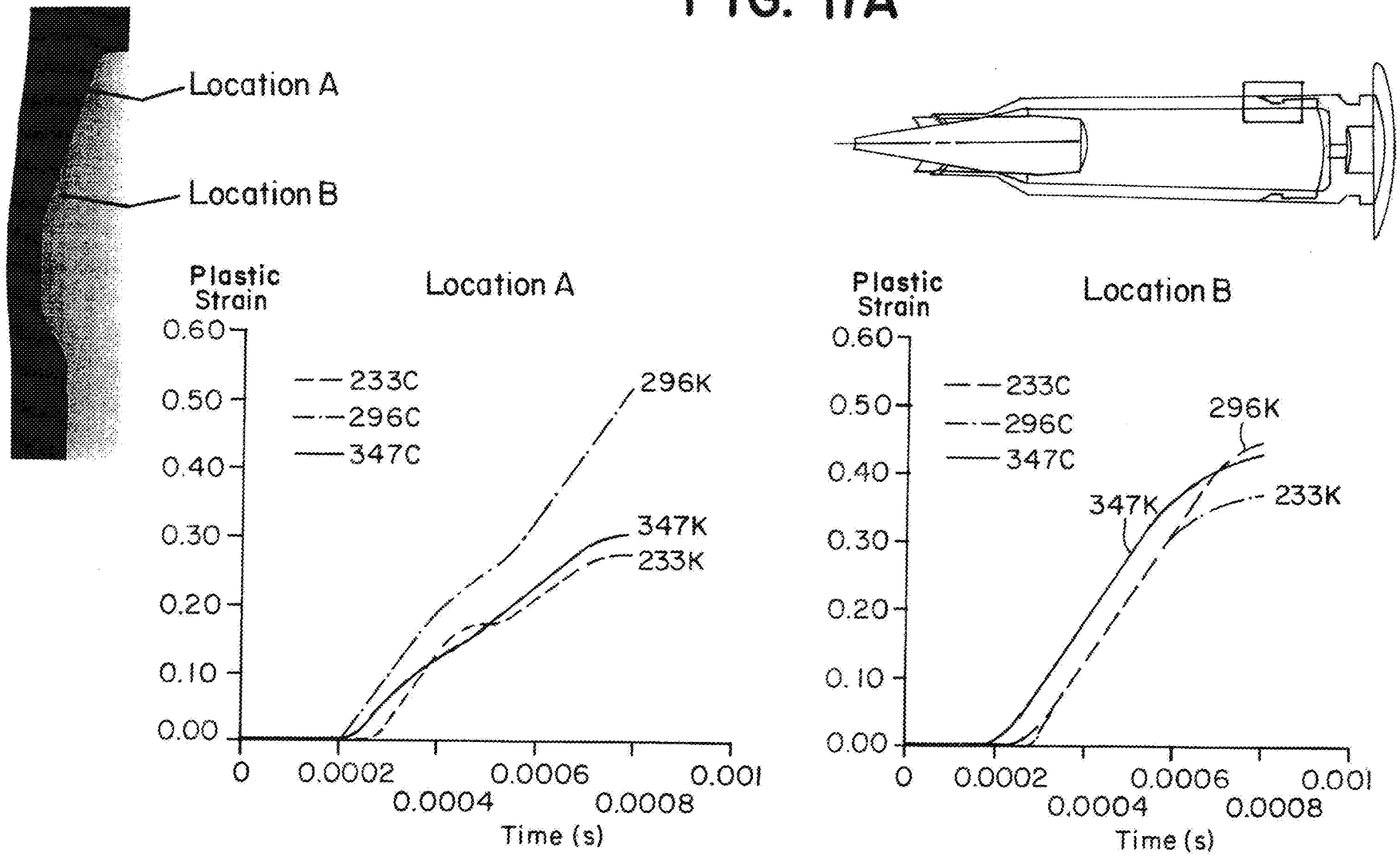
FIG. 17A has graphs of the Nominal Geometry plastic strain vs. time as a function of temperature for observed failure locations for another example of the invention.
Figure 17B:
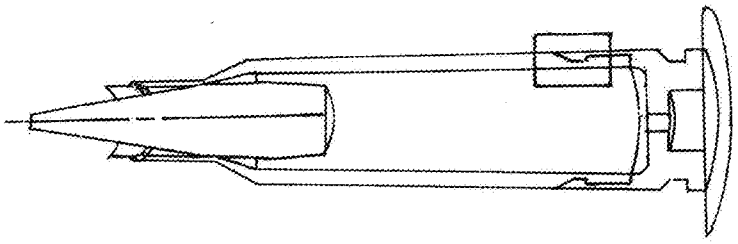
FIG. 17B has graphs of the Nominal Geometry plastic strain at observed failure locations as a function of test temperature for another example of the invention.
Figure 17B:
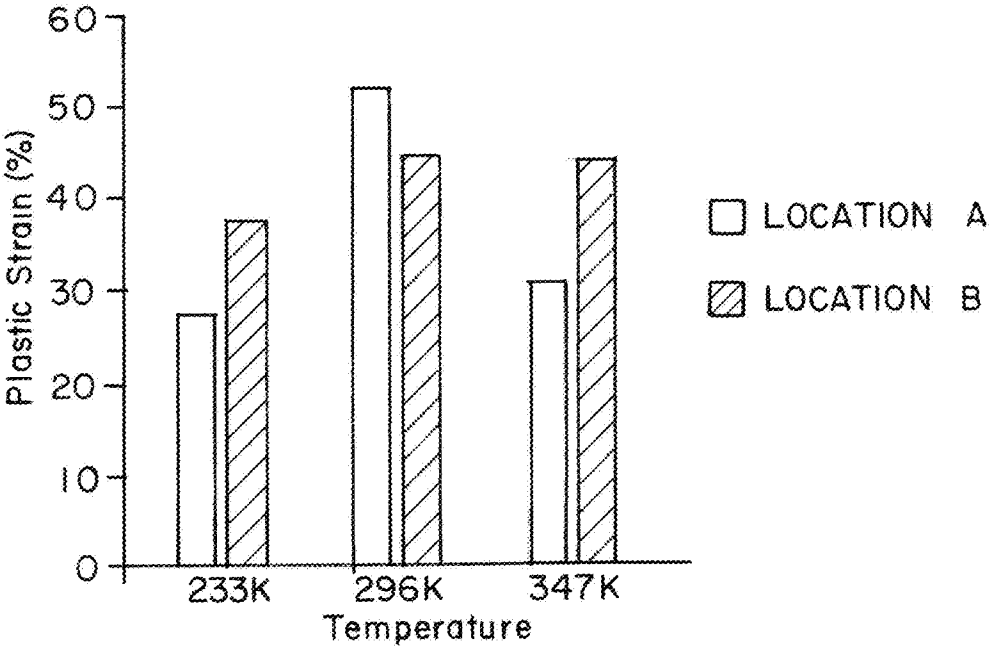
Figure 17B:
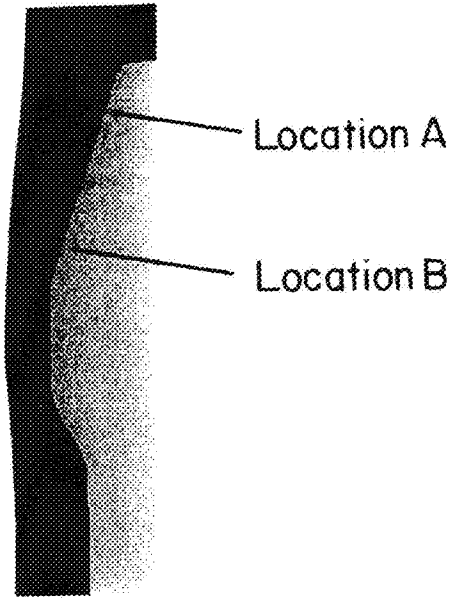

FIG. 16A is a graph of the plastic strain of the Nominal Geometry variant at 347K. Location A having a peak strain of 31%. Location B having a peak strain of 44%. FIG. 16B is a graph of the plastic strain of the Nominal Geometry variant at 296K. Location A having a peak strain of 53%. Location B having a peak strain of 45%. FIG. 16C is a graph of the plastic strain of the Nominal Geometry variant at 233K. Location A having a peak strain of 28%. Location B having a peak strain of 38%. FIG. 17A illustrates the all of the above results of the Nominal Geometry plastic strain vs. time as a function of temperature for observed failure locations of the single snap design. FIG. 17B illustrates the Nominal Geometry plastic strain at observed failure locations as a function of the same test temperatures. This allowed the inventors to understand the failure points for the single snap design under the stresses of an M240 weapon system.

Figure 18A:
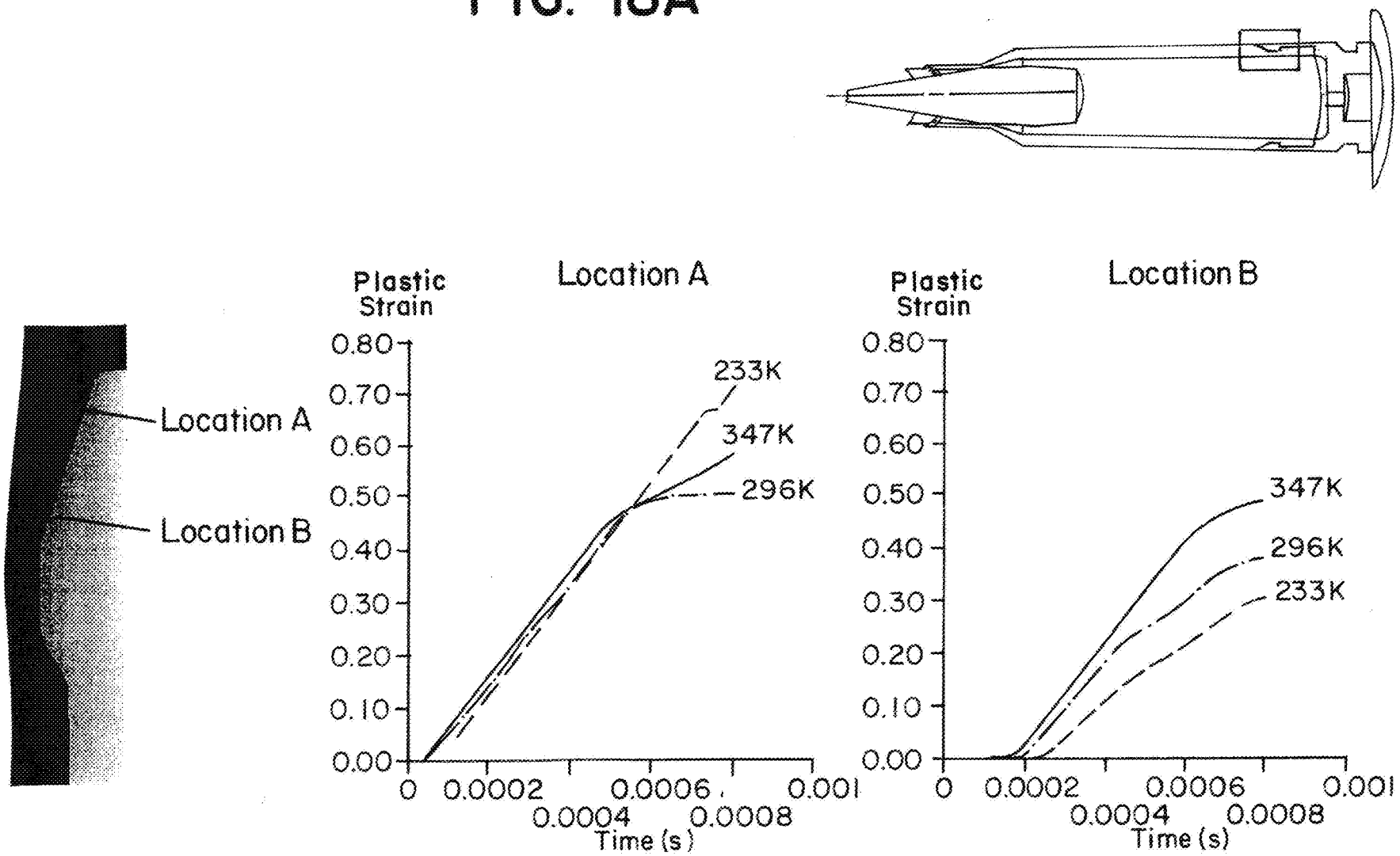
FIG. 18A has graphs of the MaxMin plastic strain vs. time as a function of temperature for observed failure locations for another example of the invention.
Figure 18B:
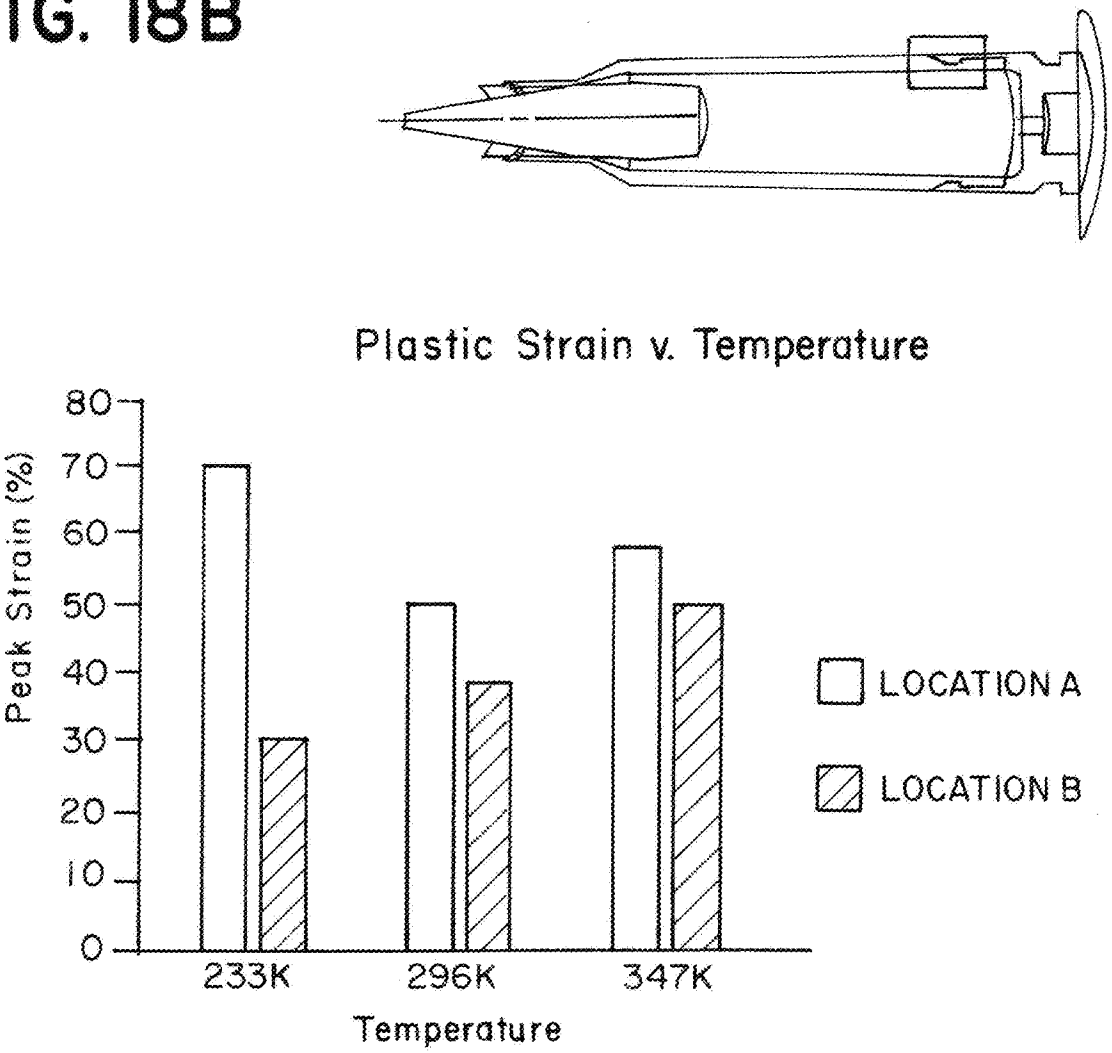
FIG. 18B has graphs of the MaxMin plastic strain at observed failure locations as a function of test temperature for another example of the invention.
Figure 18B:
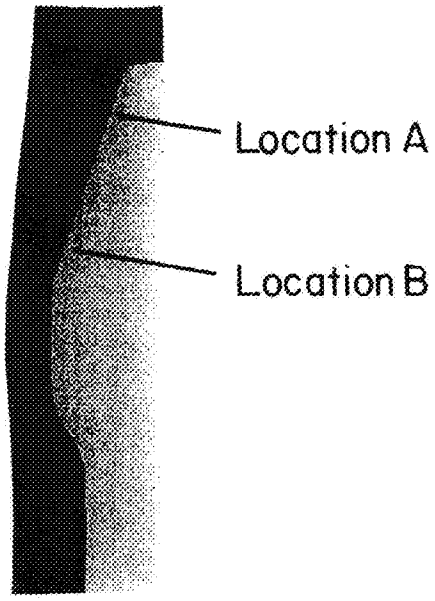
Figure 19:
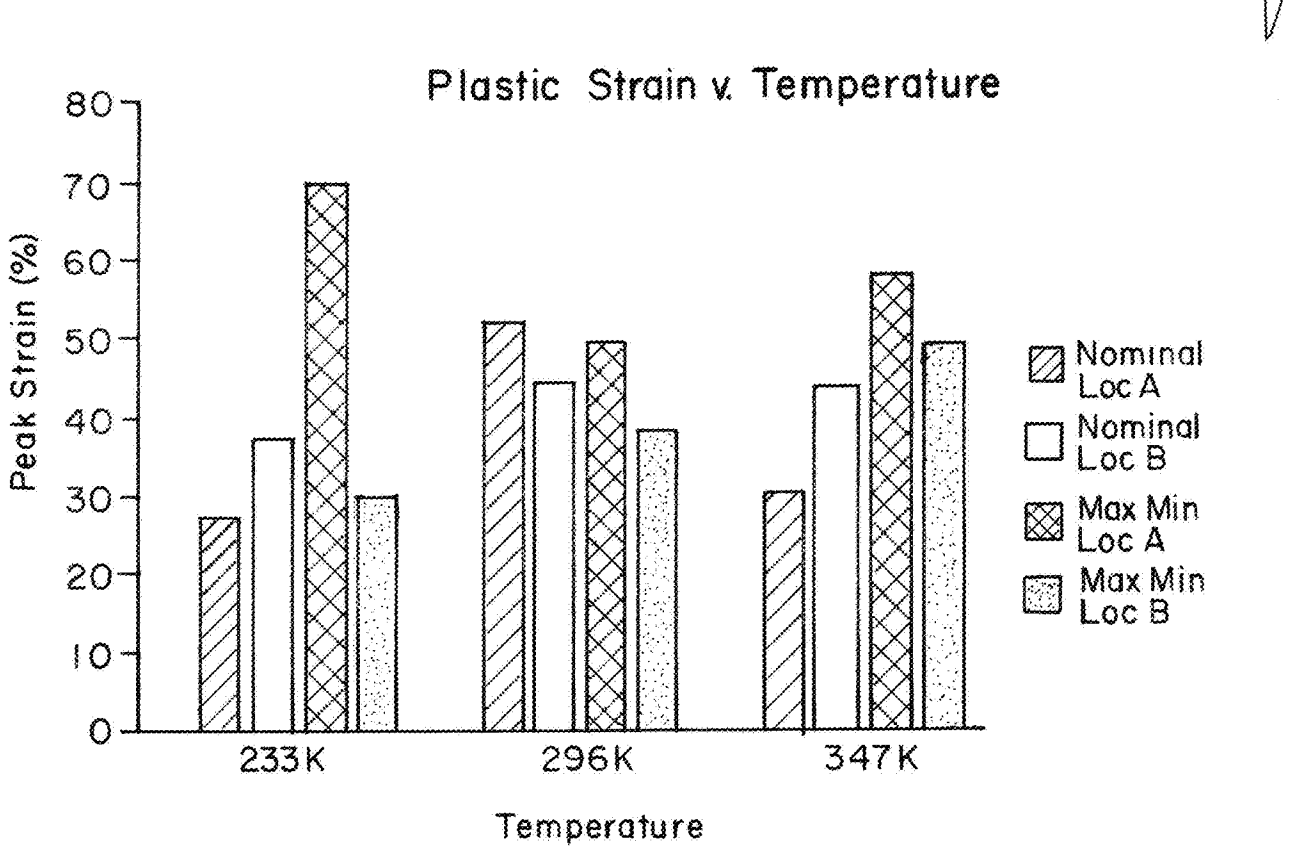
FIG. 19 has graphs comparing the plastic strain plastic strain at observed failure locations as a function of test temperature for two examples of the invention.
Figure 19:
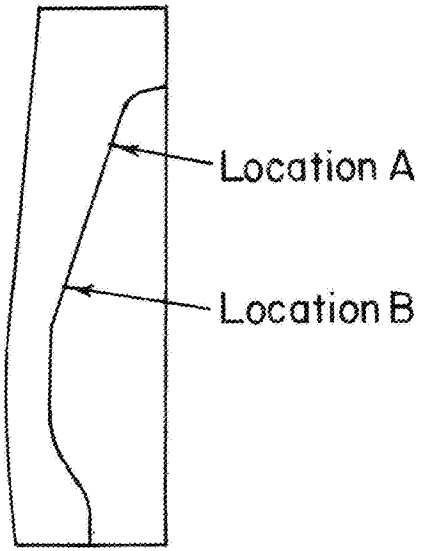

FIGS. 18A and 18B perform the same analysis as above over the same temperature ranges, except now for the MaxMin geometry condition. Plastic strain vs. time as a function of temperature for observed failure locations as illustrated in FIG. 18A. FIG. 18B illustrates the MaxMin plastic strain at observed failure locations as a function of test temperature for the MaxMin geometry. FIG. 19 compares the plastic strain over all tested temperatures for both geometry conditions above.

Figure 20:
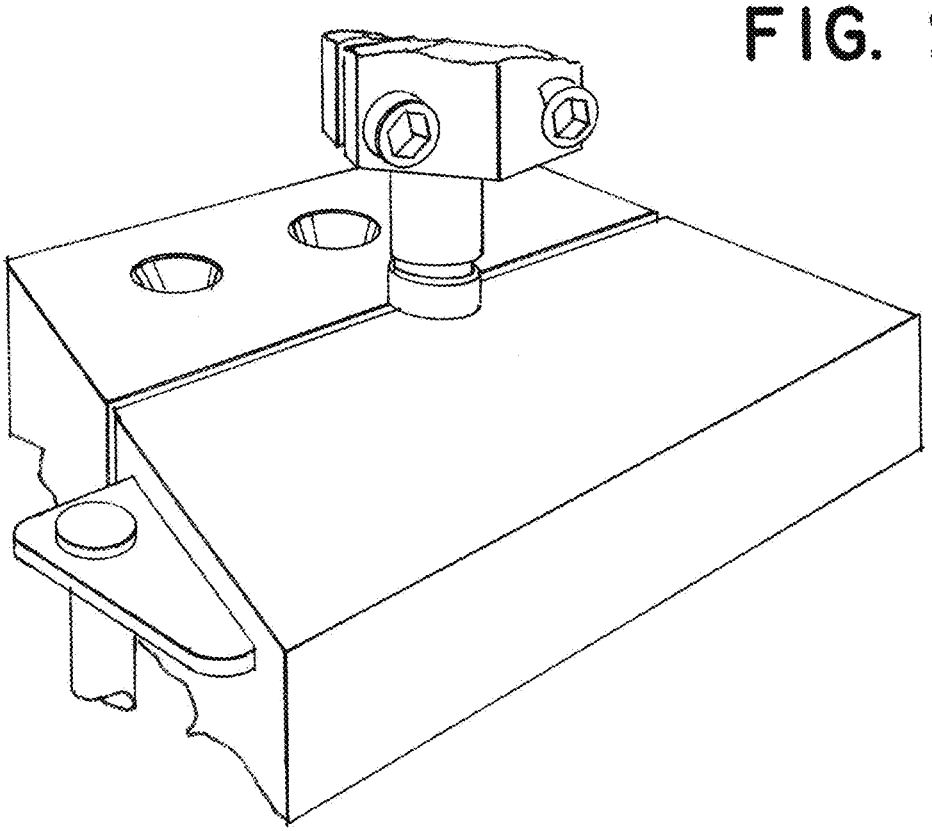
FIG. 20 illustrates an example of a cartridge undergoing tensile testing.
Figure 21:
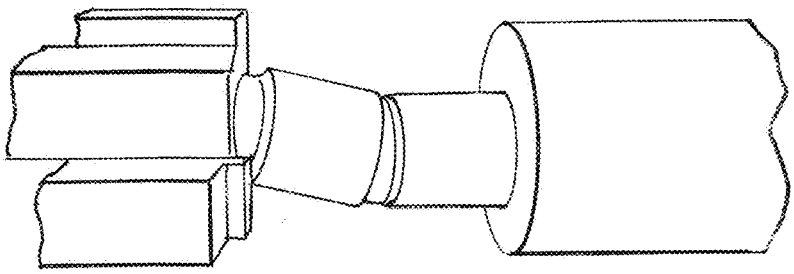
FIG. 21 illustrates insert deflection from the cartridge in a failure state.

FIGS. 20 and 21 illustrate examples of both tensile testing and a simulated example of insert failure in a M240 weapon system. Here, it is easy to see the insert separated from the cartridge body due to the force of the ejector plunger of the case head. The actual M240 bolt mechanism is to the left and a simulated chamber is on the right.

Figure 22A:
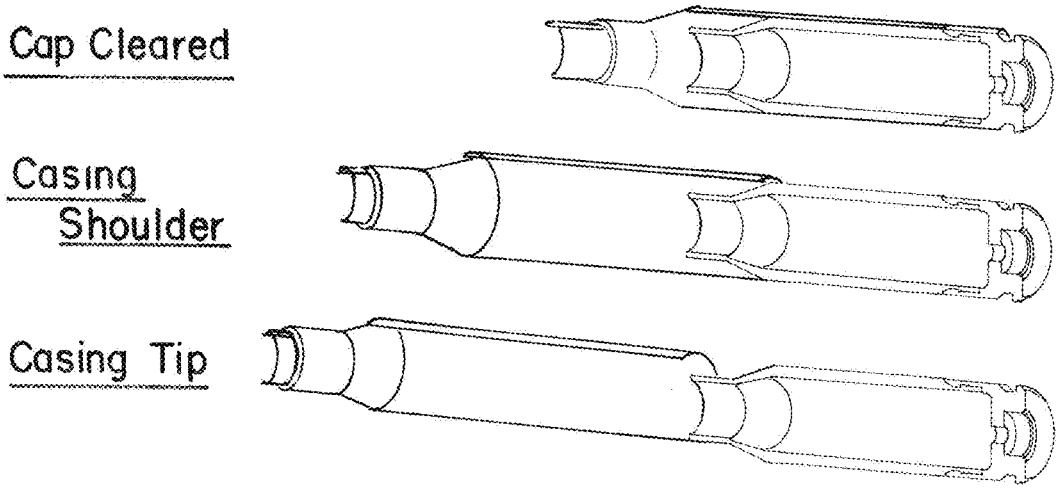
FIG. 22A illustrates the extraction torque simulation with static loading of three model geometries, the cap cleared, casing shoulder, and casing tip.

FIG. 22A illustrates the three different extraction torque simulations with static loading here where the insert (cap) has cleared the chamber but the body is contacting the walls of the chamber, next a majority of the body has cleared but the casing shoulder contacts the chamber, and that the neck (casing tip) contacts the chamber walls.

Figure 22B:
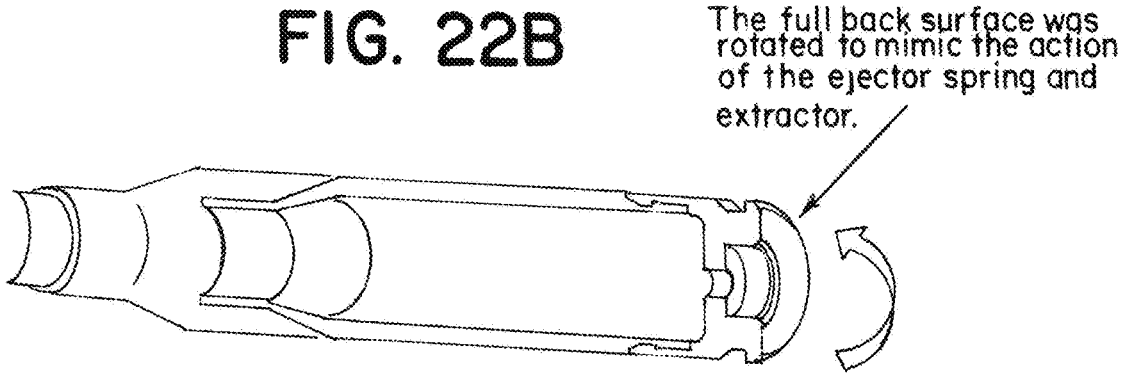
FIG. 22B illustrates additional detail relating to the extraction simulation.
Figure 22C:
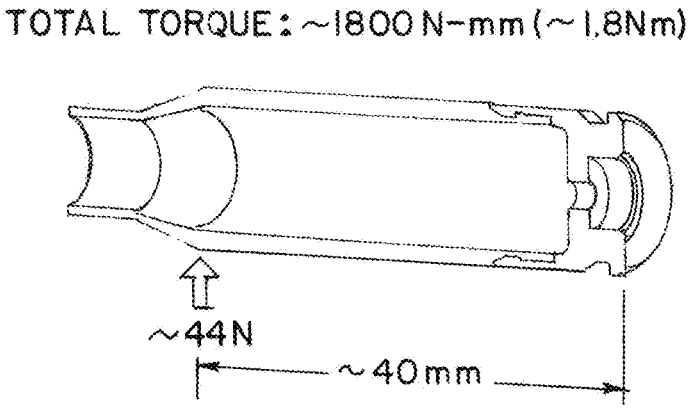
FIG. 22C illustrates the force applied to the casing shoulder to compress the ejector pin on the back insert surface.

FIG. 22B illustrates additional detail relating to the extraction simulation. The insert was loaded as a rigid body motion of the back face of the insert in order to apply a torque or pull force. The full back surface was rotated to mimic the action of the ejector spring and extractor in an M240 extraction system. FIG. 22C illustrates the force applied to the casing shoulder to compress the ejector pin on the back insert surface. As a basis for comparison of torque magnitude, the observed force ~10 lb. (~44 N) applied to the casing shoulder was required to compress the ejector pin on the back insert surface, resulting in a net torque of ~1800 N-mm.

Figure 23:
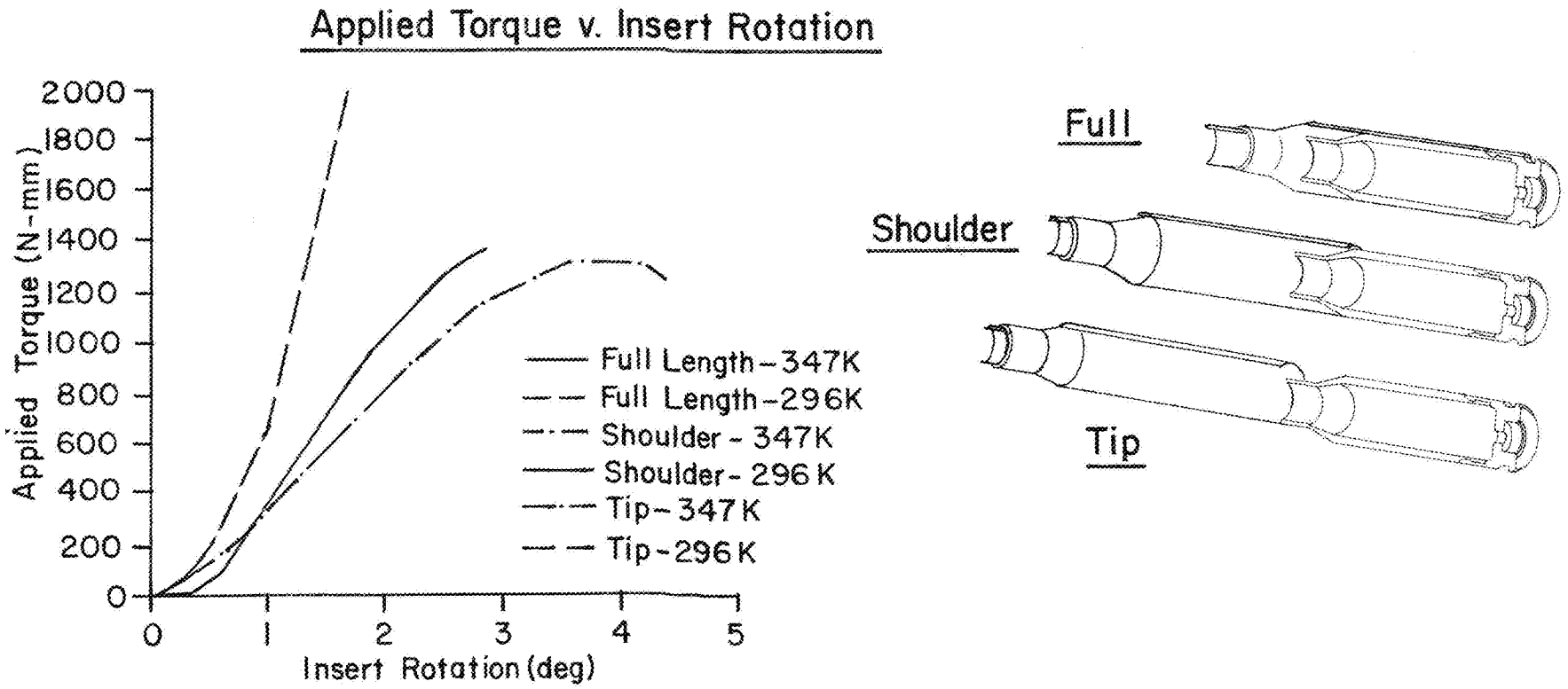
FIG. 23 is a graph of the applied torque vs. insert rotation for three examples of the invention.
Figure 24:
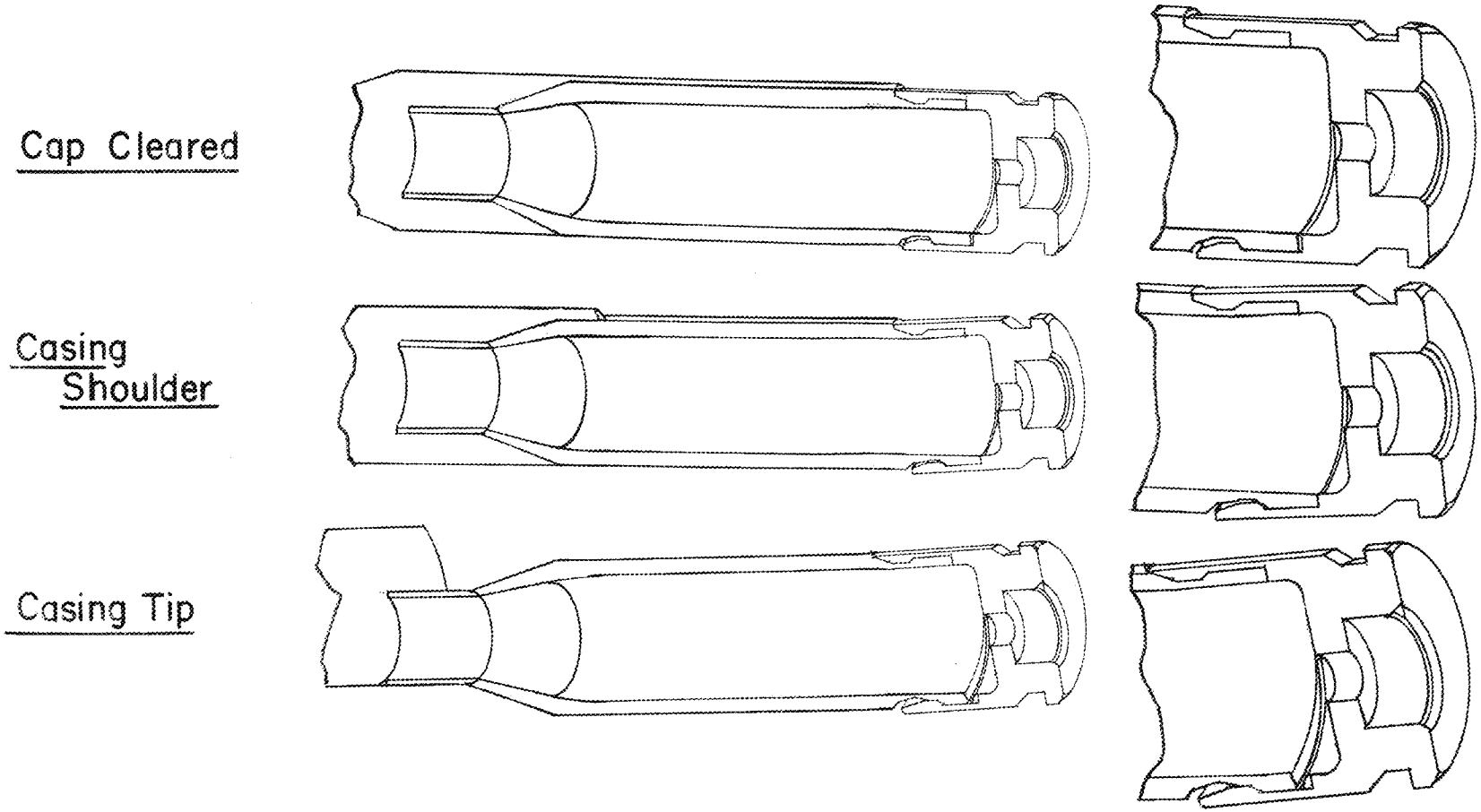
FIG. 24 illustrates the deformed shapes at ~1200 N-mm torque for three examples of the invention.
Figure 25:
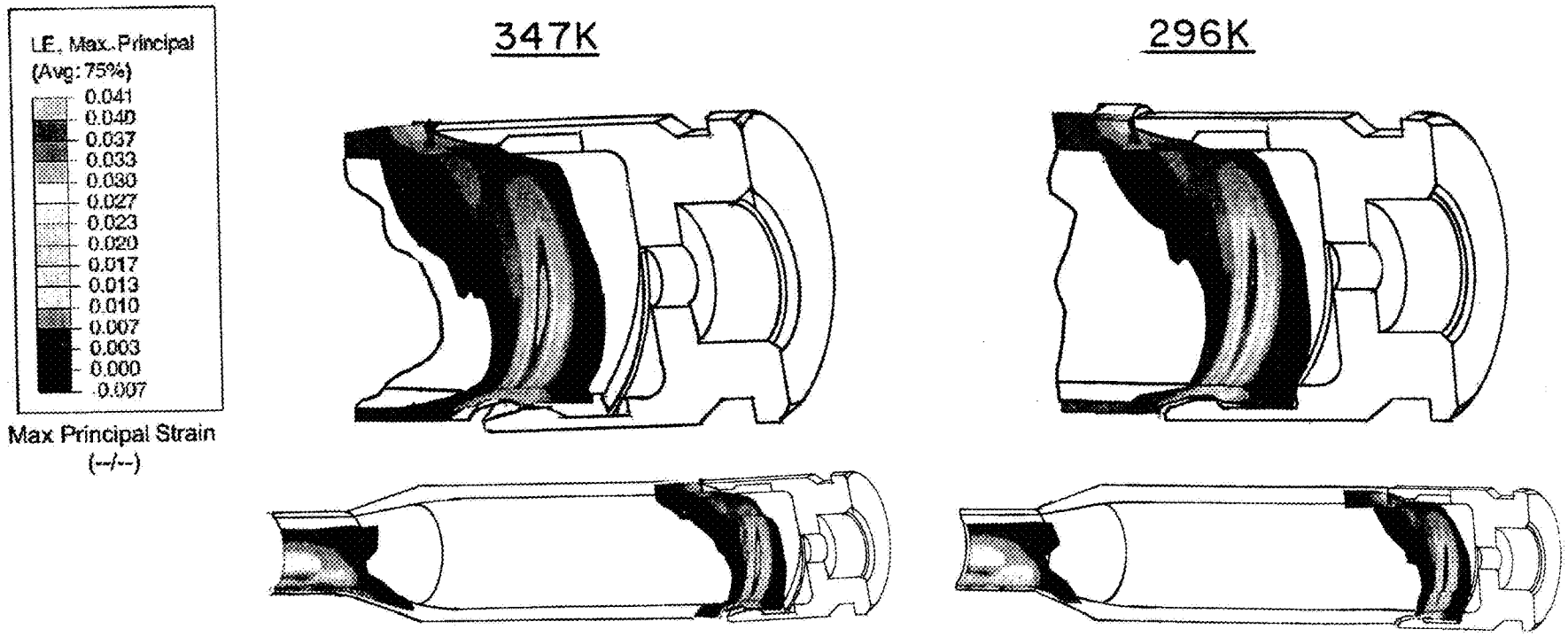
FIG. 25 illustrates the strains during extraction at ~1200 N-mm for the 'casing tip' example of the invention.

FIG. 23 is a graph of the applied torque vs. insert rotation for three examples of the invention at the three positions noted above over a number of temperatures. The inventor found that the torsional stiffness of the ejecting casing was not a function of temperature but was a function of the stage of ejection. FIG. 24 illustrates the deformed shapes at ~1200 N-mm torque for three examples of the invention. Here, the amount of stress and thus the separation of the insert from the cartridge can be seen. Supporting the conclusion above, the insert is the most "separate" in when the neck is in contact with the chamber. This makes some sense, as that is the longest "lever arm" between the force and insert. Again, FIG. 25 illustrates the strains during extraction at ~1200 N-mm for the 'casing tip' example of the invention at the hot and room temperature conditions. The stress changes are minimal, illustrating that temperature is not playing a critical role.

Note that in the examples above, the present invention can be used with single polymer body cases or multiple part polymer cases. The cases can be molded whole or assembled in multiple parts. The polymers herein can be any polymer or polymer metal/glass blend suitable to withstand the forces of loading, firing and extracting over a wide temperature range as defined by any commercial or military specification. The metal or metal alloys can be, again, any material that can withstand the necessary forces. The base can be formed by any method, including casting, hydroforming, and turning. The above inventive concepts can be used for any case for any caliber, either presently known or invented in the future.

While the foregoing has described what are considered to be the best mode and/or other examples, it is understood that various modifications may be made therein and that the subject matter disclosed herein may be implemented in various forms and examples, and that the teachings may be applied in numerous applications, only some of which have been described herein. It is intended by the following claims to claim any and all applications, modifications and variations that fall within the true scope of the present teachings.

We claim:

1. A high strength polymer-based cartridge, comprising:

a polymer case, comprising:

- a first end having a mouth;
- a body formed below the mouth and having a propellant chamber and a longitudinal axis;
- a back end, opposite the first end, and formed below the body, comprising:
  - a first snap ridge comprising a first ridge angle at approximately at 90° to the longitudinal axis;
  - a first snap spacer depending from the first snap ridge and away from the mouth and approximately parallel to the longitudinal axis;
  - a first snap slope depending from the first snap spacer and away from the mouth;
  - a second snap ridge, positioned closer to the first end than the first snap ridge, comprising a second ridge angle at approximately at 90° to the longitudinal axis;
  - a second snap spacer depending from the second snap ridge and away from the mouth and approximately parallel to the longitudinal axis;
  - a second snap slope depending from the second snap spacer and away from the mouth;
  - a leading edge, positioned closer to the first end than the second snap ridge, comprising at least one of a sloped or radiused edge; and an insert formed from at least one of a metal and metal alloy configured to engage the back end, the insert comprising a rear end, an extraction lip, a groove, an annular cylindrical wall, a primer cavity, and a flash hole.

2. The polymer-based cartridge of claim 1, wherein:

the first snap slope comprising a first slope angle at approximately at 15° to the longitudinal axis; and the second snap slope, positioned closer to the first end than the first snap slope, comprising a second slope angle at approximately at 15° to the longitudinal axis.

3. The polymer-based cartridge of claim 1, wherein the leading edge is sloped at approximately 10° to the longitudinal axis.

* * * * *